US006327888B1

(12) United States Patent
Kadlec

(10) Patent No.: US 6,327,888 B1
(45) Date of Patent: Dec. 11, 2001

(54) TRANSFER APPARATUS

(75) Inventor: Jan Kadlec, Kitchener (CA)

(73) Assignee: Technologies 2000 (Kitchener) Ltd., Kitchener (CA)

( * ) Notice: Subject to any disclaimer, the term of this patent is extended or adjusted under 35 U.S.C. 154(b) by 0 days.

(21) Appl. No.: 09/593,402

(22) Filed: Jun. 14, 2000

(51) Int. Cl.[7] ..... B21D 43/05

(52) U.S. Cl. ..... 72/405.16; 72/405.01; 198/621.1

(58) Field of Search ..... 72/405.13, 405.16, 72/405.09, 405.01; 198/621.1, 621.3

(56) References Cited

U.S. PATENT DOCUMENTS

| | | | | |
|---|---|---|---|---|
| 3,138,128 | | 6/1964 | Sofy . | |
| 3,262,541 | * | 7/1966 | De Gain | 198/621.1 |
| 3,421,637 | | 1/1969 | Sofy . | |
| 3,521,760 | * | 7/1970 | Wallis | 198/621.1 |
| 3,684,304 | | 8/1972 | Dexter et al. . | |
| 3,746,184 | * | 7/1973 | Wallis | 198/621.1 |
| 4,032,018 | * | 6/1977 | Wallis | 72/405.13 |
| 4,198,845 | | 4/1980 | Sofy | 72/421 |
| 4,436,199 | | 3/1984 | Baba . | |
| 4,513,602 | | 4/1985 | Sofy | 72/421 |
| 4,833,908 | | 5/1989 | Sofy . | |
| 5,123,271 | | 6/1992 | Sofy et al. | 72/336 |
| 5,557,959 | | 9/1996 | Wallis et al. | 72/405.13 |
| 5,572,898 | | 11/1996 | Horde et al. | 72/405.16 |
| 5,586,464 | | 12/1996 | Horde et al. | 72/405.16 |
| 5,899,109 | | 5/1999 | Fisch | 72/405.16 |
| 5,906,131 | | 5/1999 | Fisch | 72/405.16 |

FOREIGN PATENT DOCUMENTS

| | | | | |
|---|---|---|---|---|
| 4032340 | * | 4/1992 | (DE) | 72/405.13 |

* cited by examiner

*Primary Examiner*—Daniel C. Crane

(57) ABSTRACT

A transfer apparatus is proposed for transferring workpieces between die stations comprising a striker cam driver by a press ram, a rotary gear urged to rotate by the striker cam, a shaft extending from the rotary gear and characterized by a distal end, and a finger bar pivotally coupled to the distal end and assuming arcuate travel above the die stations in response to rotation of the rotary gear. The transfer apparatus can further comprise a linear cam including a slot, a pusher plate including a cam follower extending therefrom and disposed in the slot, moveable horizontally in response to vertical displacement of the linear cam, and a finger bar, moveable into and out of engagement with the workpieces, in response to the horizontal movement of the pusher plate.

27 Claims, 16 Drawing Sheets

CLOSING
Continues from Figs. 3 & 4

TRANSFER APPARATUS

FIELD OF THE INVENTION

This invention relates to transfer assemblies and, more particularly, to transfer assemblies used in progressive die type punch presses.

BACKGROUND OF THE INVENTION

Workpiece transfer assemblies used in progressive die type punch presses are well known in the prior art. Such transfer assemblies are disclosed in U.S. Pat. No. 3,138,128, U.S. Pat. 3,421,637, U.S. Pat. No. 4,198,845, U.S. Pat. No. 4,436,199, U.S. Pat. No. 4,513,602, and U.S. Pat. 4,833,908.

A typical transfer apparatus includes a first motive means for reciprocating a finger bar laterally into and out of engagement with workpieces at die stations and upwardly and downwardly with respect to the die stations, and a second motive means for reciprocating the finger bar longitudinally for transferring workpieces between successive die stations. The first motive means causes the finger bar to move laterally into engagement with workpieces at their respective die station and then lift such workpieces above the die stations. In entering into engagement and then lifting the workpieces, the finger bar negotiates a sharp 90° turn. The finger bar then negotiates a further sharp 90° turn while the workpieces are indexed between successive die stations. These abrupt changes in velocity causes undesirable stresses to component parts of the transfer apparatus, eventually causing misalignment of such components and thereby compromising the efficiency of transfer operations performed thereby.

SUMMARY OF THE INVENTION

In a broad aspect, of the present invention, there is provided a transfer apparatus for transferring workpieces between die stations. The transfer apparatus including a press ram, a striker cam operatively driven by the press ram, a rotary gear adapted to be rotated in response to movement of the striker cam, a drive shaft, and a finger bar. The drive shaft extends from the rotary gear and is characterized by a distal end. The finger bar is coupled to the distal end of the drive shaft and is pivotally mounted to assume arcuate travel above the die stations in response to rotation of the rotary gear.

BRIEF DESCRIPTION OF THE DRAWINGS

Further advantages of the present invention will appear from the following detailed description of the invention, taken together with the following drawings in which.

DETAILED DESCRIPTION

Figure 1:
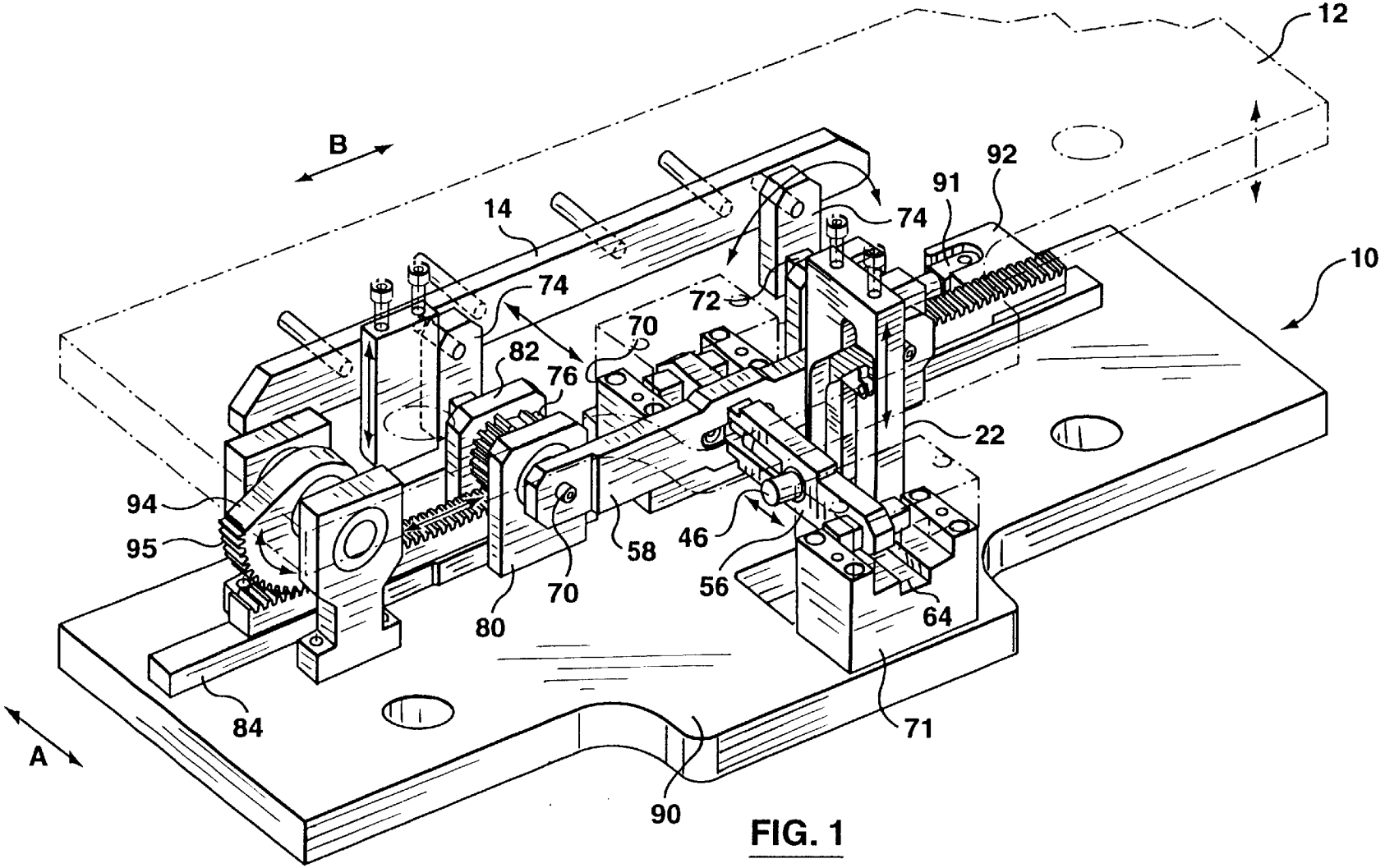
FIG. 1 is a top perspective view of an embodiment of a transfer apparatus of the present invention.
Figure 1A:
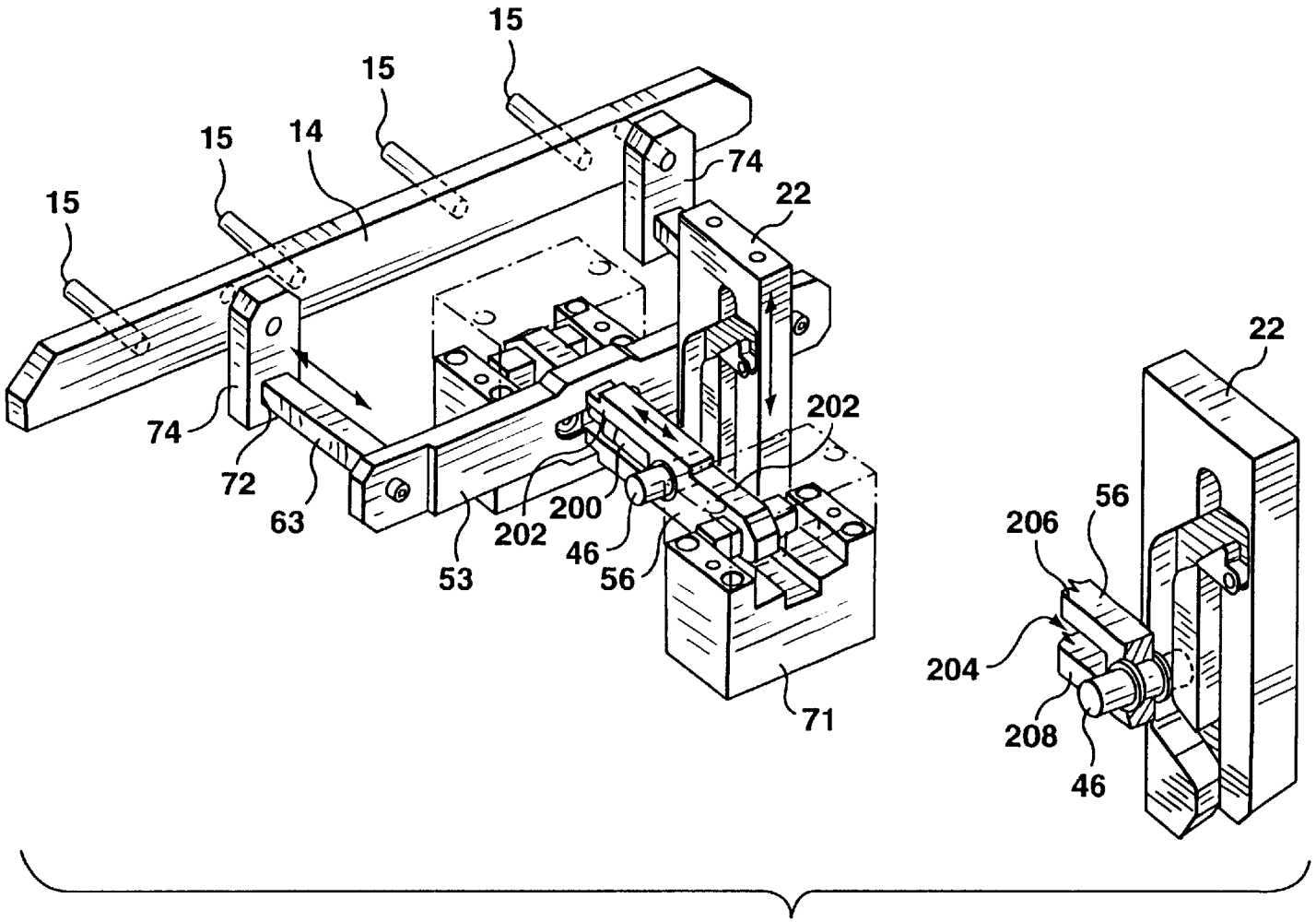
FIG. 1*a* is a top perspective view illustrating the linear cam, pusher arm, crossbar, shaft, linkage, and finger bar of the transfer apparatus illustrated in FIG. 1.

FIGS. 1, 1(*a*), 1(*b*), and 2 show an embodiment of a transfer apparatus 10 of the present invention. Transfer apparatus 10 is adapted to transfer workpieces 16 progressively from one die station 18 to the next. The transfer apparatus 10 is adapted for operation with a press ram 12 and a series of in-line die stations 18, wherein the workpieces 16 are progressively transferred from a first die station to the next in-line die station so that a plurality of sequential forming operations may be performed on them. It will be appreciated that directional adjectives such as "longitudinal" and "lateral" are taken with reference to the direction of motion of workpieces between and through successive die stations with the lateral direction being the direction shown in arrows "A" and longitudinal being the direction shown in arrows "B" in FIG. 1.

Motion to transfer apparatus 10 is imparted by press ram 12. In this respect, linear cam 22 and striker cam 24 are mounted to and extend below press ram 12, thereby reciprocating with press ram 12 in a vertical motion, and translating motion of press ram 12 to transfer apparatus 10. Linear cam 22 imparts lateral movement to finger bar 14, thereby moving finger bar 14 into and out of engagement with workpieces 16. Actual engagement of workpieces 16 is by a plurality of fingers 15, such engagement being effected in a manner as is well known in the art. Striker cam 24 causes longitudinal movement of finger bar 14, thereby facilitating movement of workpieces 16 between die stations 18.

Figure 3:
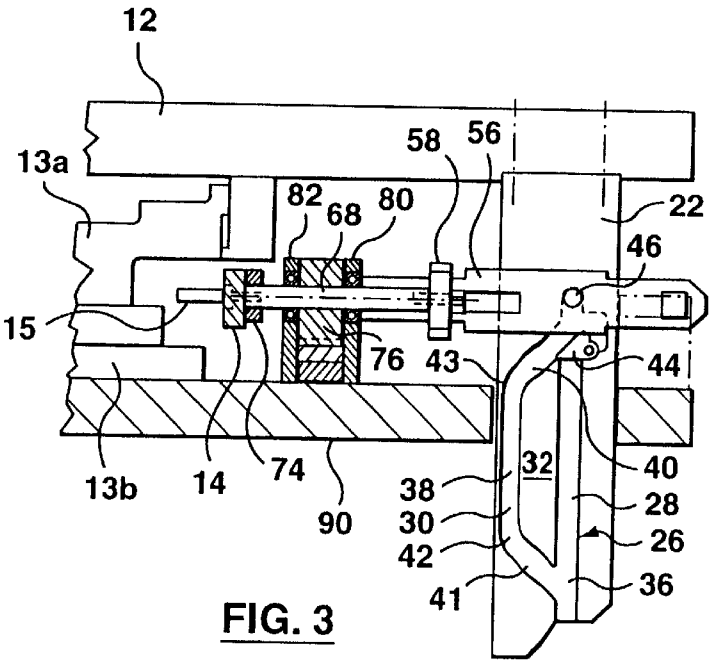
FIG. 3 is a side elevation view, partly in section, illustrating an embodiment of a transfer apparatus of the present invention illustrated in the fully closed position.

Linear cam 22 includes a guide slot 26 having an outer slot segment 28 joined to an inner slot segment 30 (See FIG. 3). Outer slot segment 28 is separated from inner slot segment 30 by vertical wall 32. Outer slot segment 28 comprises a vertical slot having an upper end 34 and a lower end 36. Inner slot segment 30 includes a vertical inner slot portion 38 and first and second inclined inner slot portions 40 and 41. Vertical inner slot portion 38 has a lower end 42 and an upper end 43. First inclined inner slot portion 40 extends upwardly and rearwardly from upper end 43, at an angle of inclination above the horizontal, into outer slot segment 28 at a point immediately below upper end 34. Second inclined inner slot portion 41 extends downwardly and rearwardly from lower end 42, at an angle of inclination below the horizontal, into outer slot segment 28 at a point immediately above lower end 36.

Pivotal bridge 44 is provided and associated with linear cam 22. Pivotal bridge 44 guides travel of an associated cam follower 46 within guide slot 26. In particular, bridge 44 pivots upwardly to permit the cam follower 46 to be guided within outer slot segment 28 as the press ram 12 moves downwardly from a fully open position to a fully closed position, so that the cam follower 46 is disposed at the lower end 36 when the downward movement begins, and is disposed at the upper end 34 when the downward movement of the press ram 12 is completed. Further, bridge 44 provides a barrier to prevent the cam follower 46 from being guided along the outer slot segment 28 from upper end 34 to lower end 36 as the press ram 12 moves upwardly from the fully closed position, so that the bridge 44 guides cam follower 46 into first inclined inner slot portion 40 of inner slot segment 30, as will be further described below.

Figures 25, 26, 27, 28:
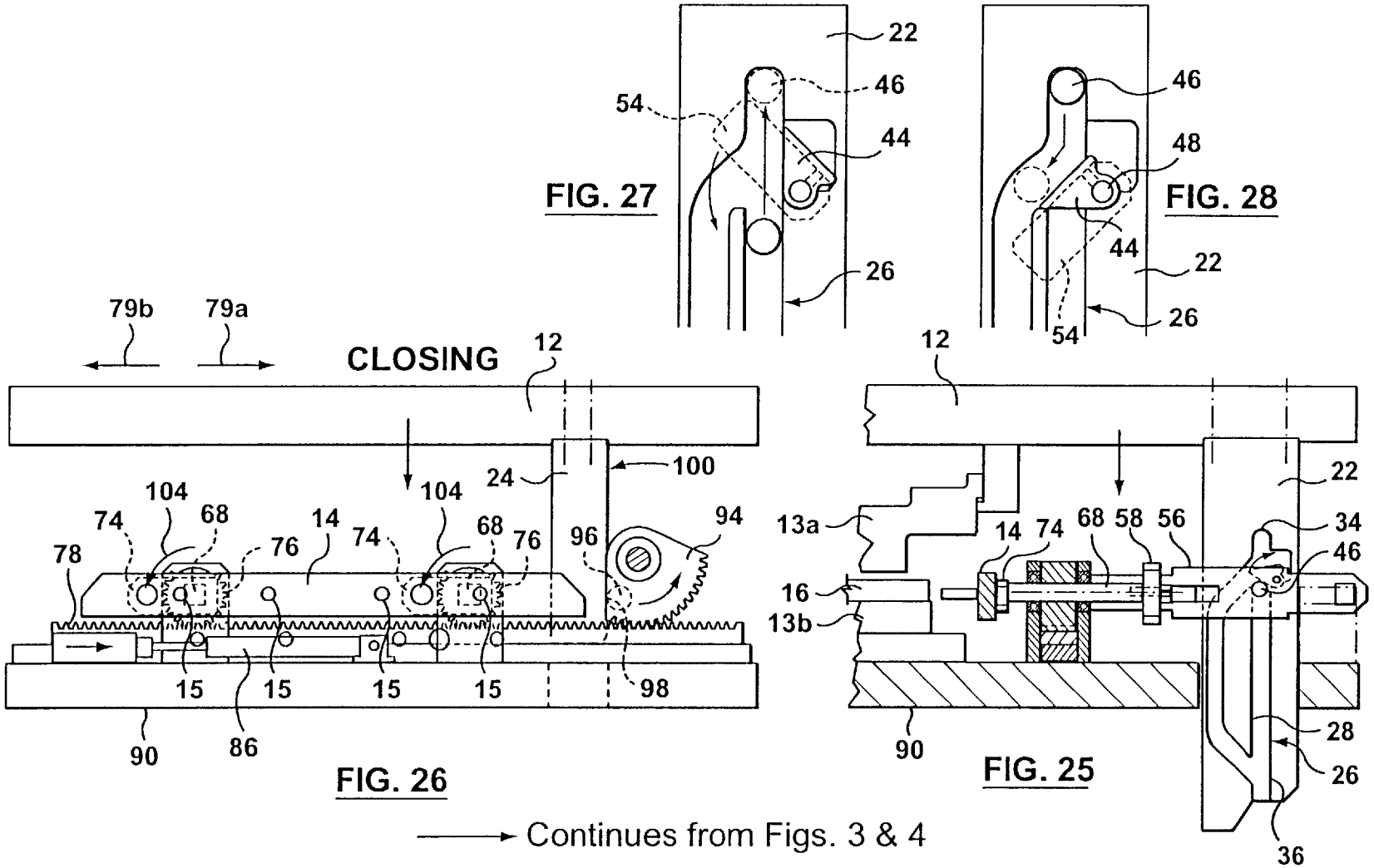
FIG. 25 is a side elevation view, partly in section, illustrating an embodiment of a transfer apparatus of the present invention illustrated in an eleventh intermediate open position.
FIG. 26 is a front elevation view, partly in section, illustrating an embodiment of a transfer apparatus of the present invention illustrated in an eleventh intermediate open position.
FIG. 27 is a side elevation view, partly cut away, illustrating pivotal rotation of a bridge provided on a linear cam in an embodiment of the transfer apparatus of the present invention as a cam follower moves upwardly within an outer slot of the linear cam.
FIG. 28 is a side elevation view, partly cut away, illustrating directed movement of a cam follower within an upper inclined slot of a linear cam by a bridge in an embodiment of the transfer apparatus of the present invention.

Bridge 44 is pivotable to permit the cam follower 46 to be guided along the outer slot segment 28 as the press ram 12 moves from the fully open position to the fully closed position (see FIGS. 27 and 28). In this respect, bridge 44 is pivotally mounted to linear cam 22 by pin 48. Pin 48 has a first end 50 connected to bridge 44 and a second end 52 connected to counterweight 54. Bridge 44 is characterized by a first position, shown in FIG. 28, whereby bridge 44 guides cam follower 46 from upper end 34 to inner slot segment 30 as the press ram 12 moves upwardly from the fully closed position. In this respect, counterweight 54 is of sufficient weight to bias bridge 44 towards the first position. Bridge 44 is further characterized by a second position, shown in FIG. 27, wherein bridge 44 has pivotally rotated in a clockwise manner, as shown in FIG. 27, relative to the first position shown in FIG. 28, to permit the cam follower 46 to be guided in the outer slot segment 28 as the press ram 12 moves from the open position to the fully closed position. In this respect, counterweight 54 is not so heavy as to prevent bridge 44 from pivotally rotating about pin 48 and swinging upwardly and out of the way of cam follower 46 as the linear cam 22 moves downwardly relative to the cam follower 46 as the press ram 12 moves from the fully open position to the fully closed position.

Figure 2:
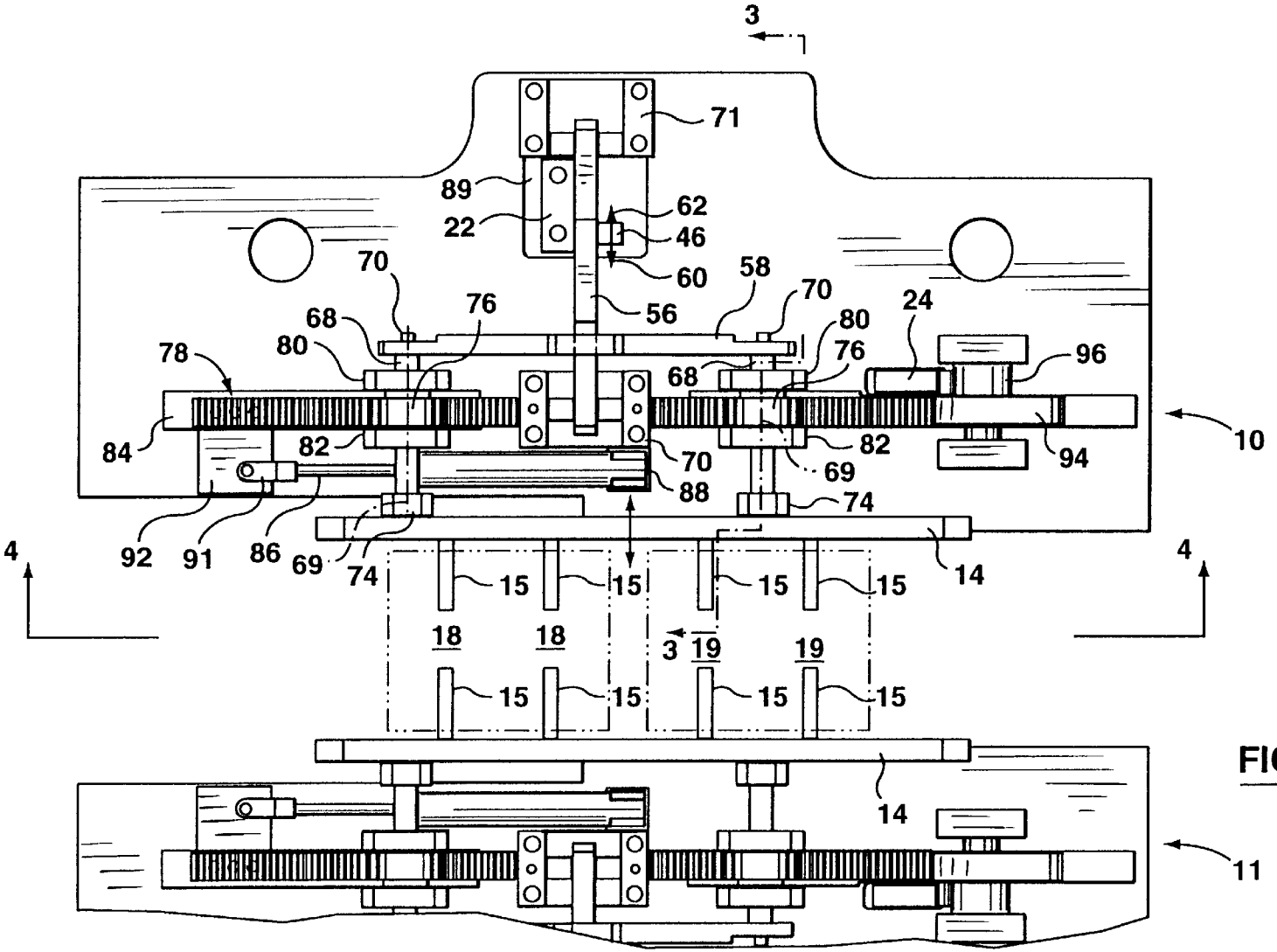
FIG. 2 is a top plan view of a further embodiment of the transfer apparatus of the present invention.

As has been described, the cam follower 46 is provided to be guided by guide slot 26. In this regard, vertical movement of linear cam 22 is transferred to movement in the lateral direction of cam follower 46 as the linear cam 22 moves upwardly with the press ram 12. Cam follower 46 is mounted on pusher arm 56 which is adapted to urge crossbar 58 in laterally forward and rearward directions (denoted by directional arrows 60 and 62 respectively, as shown in FIG. 2), thereby causing finger bar 14 to move into and out of engagement with workpieces 16. Pusher arm 56 is mounted on linear bearings 64 and 66 provided on bearing blocks 71 and 70, thereby facilitating smooth travel of pusher arm 56 in laterally forward and rearward directions.

Figure 1B:
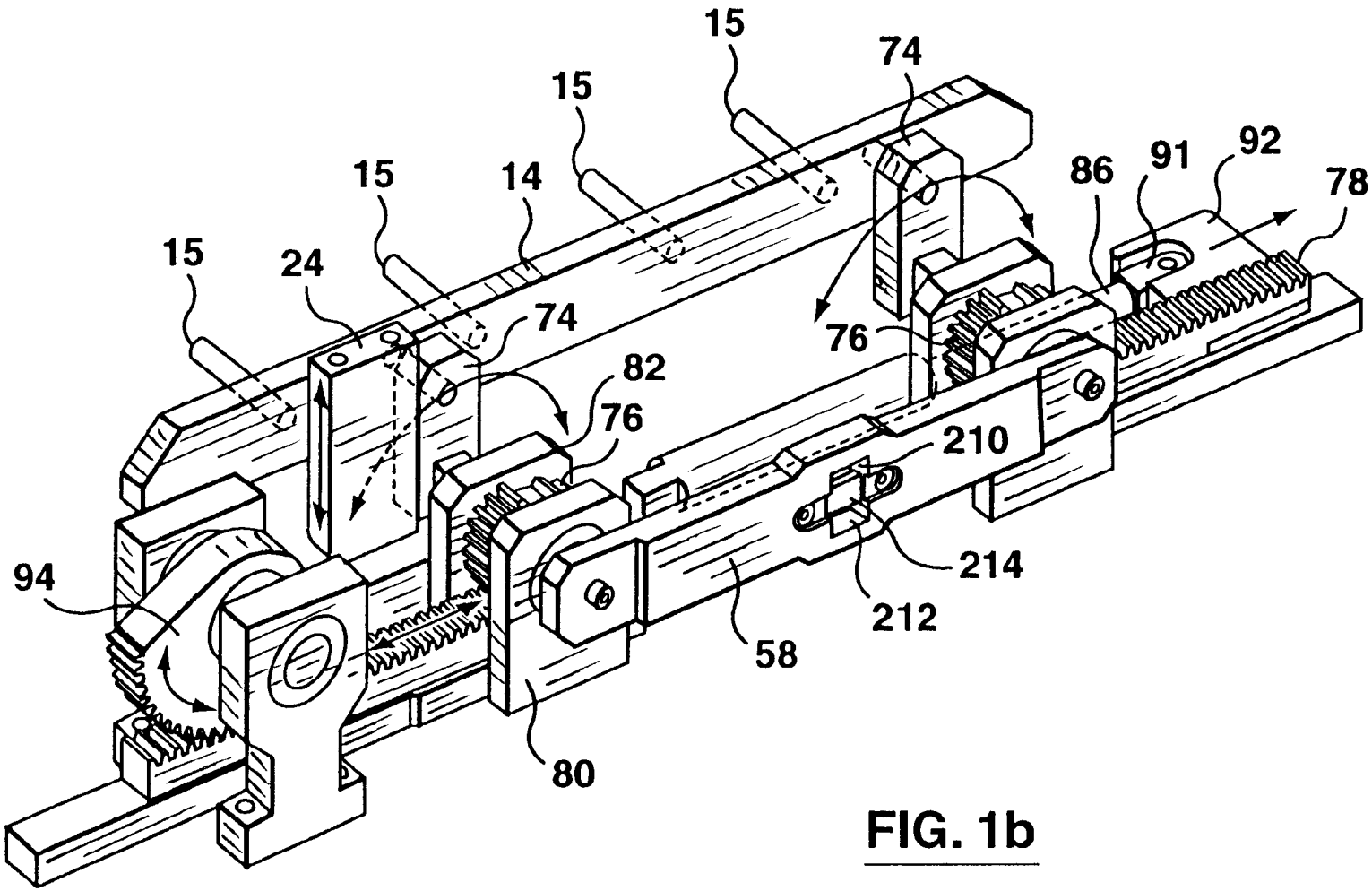
FIG. 1*b* illustrates the striker cam, drive gear, gear rack, rotary gear, shaft, linkage, and finger bar of the transfer apparatus illustrated in FIG. 1.

Crossbar 58 is mounted to and driven by pusher arm 56. In one embodiment, crossbar 58 is mounted to pusher arm 56 in such a way that pusher arm 56 does not inadvertently cause damage to crossbar 58 or components connected thereto in the event that movement of crossbar 58 is impeded by a foreign object, or by any other abnormal operating condition, whilst pusher arm 56 is being urged forwardly by linear cam 22. In this respect, in one embodiment, pusher arm 56 includes a collapsible member 200 mounted to crossbar 58 (FIG. 1(*a*). Collapsible member 200 is capable of reducing its length in the direction of the axis of pusher arm 56 under abnormal operating conditions. That is, under normal operating conditions, as linear cam 22 urges forward or rearward travel of pusher arm 56 via cam follower 46, collapsible member 200 does not change in length. However, where movement of crossbar 58 is impeded by a foreign object, collapsible member 200 is adapted to collapse or assume a reduced length to accommodate or absorb lateral travel of cam follower 46 through first inclined inner slot portion 40 in linear cam 22. In one embodiment, pusher arm 56 includes a rigid portion 202 and a slot or opening 204 for receiving collapsible member 200. The slot 204 is formed within rigid portion 202 to define upper and lower arm segments 206 and 208. Upper and lower arm segments 206 and 208 extend through and are slide fit mounted within slots 210 and 212 formed within crossbar 58. Collapsible member 200 is mounted at one end of slot 210 to crossbar 58, and particularly, in the embodiment shown, to bridge section 214 provided between slots 210 and 212 (see FIG. 1*b*). In one embodiment, collapsible member 200 is a gas cylinder characterized by a pressure rating of 300 psi. In this respect, such gas cylinder will not collapse or become reduced in length unless and until an equivalent force is exerted in the opposite direction on crossbar 58.

A pair of drive shafts 68 extend from crossbar 58 and are each characterized by axes 69 substantially parallel to one another and also substantially parallel to the axis of pusher arm 56. Each drive shaft 68 includes a first end 70 extending orthogonally from and pivotally mounted to crossbar 58, and further includes a second end 72 pivotally mounted to finger bar 14 at a point radially disposed from the axes 69 of drive shafts 68. In this respect, a linkage 74 extends from each second end 72 and is pivotally coupled to finger bar 14 eccentrically from the axis 69 of each drive shaft 68. Linear cam 22 urges finger bar 14 in laterally forward and rearward directions by imparting motion through the combination of pusher arm 56, crossbar 58, and drive shafts 68. As can be seen in FIG. 2, in one embodiment, the transfer apparatus 10 cooperates with a second transfer apparatus 11 to engage workpieces 16 (not shown in FIG. 2), as is known in the art. It will be appreciated that the finger bar 14 shown in FIGS. 1 and 2 is only one of many mechanisms for contacting workpieces which are known in the art.

Each drive shaft 68 further extends through and is slidingly received within throughbore 75 formed within a rotatable gear 76, and is thereby capable of reciprocal movement therethrough. Each drive shaft 68 is also rotatable with associated gear 76, and torque is thereby imparted to finger bar 14, as will be further described below. In the embodiment illustrated in FIGS. 1(*a*) and 16, each drive shaft 68 is characterized by a square profile and is correspondingly fitted within a square-shaped throughbore 77 of corresponding gear 76, thereby facilitating transferral of rotary motion of gear 76 to drive shaft 68.

Figure 4:
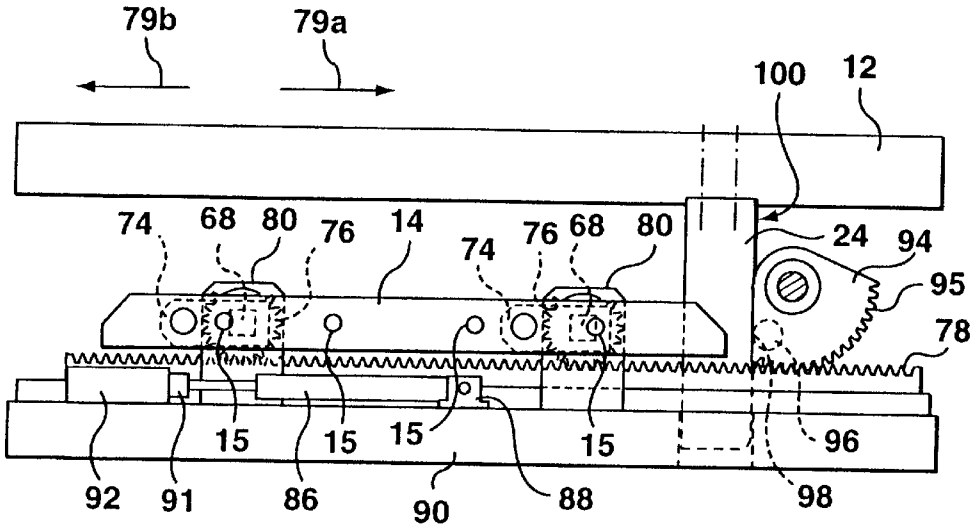
FIG. 4 is a front elevation view, partly in section, illustrating an embodiment of a transfer apparatus of the present invention illustrated in the fully closed position.

Each gear 76 is meshed with gear rack 78. Each gear 76 is further rotatably mounted on corresponding drive shaft 68 between and associated with bearing blocks 80 and 82. Bearing blocks 80 and 82 further rotatably support the associated drive shaft 68. Gear rack 78 is mounted for longitudinal movement upon linear bearing 84 in the direction denoted by directional arrows 79*a* and 79*b* (see FIG. 4). Gear rack 78 is biased towards a first position by extendible member 86. Extendible member 86 is fixedly mounted at a first end 88 to support surface 90 and includes a retractable second end 91 which is connected to tab 92 provided on gear rack 78. In the embodiment illustrated in FIG. 2, extendible member 86 is a gas piston cylinder assembly. Extendible member 86 urges longitudinal movement of gear rack 78 in a direction denoted by directional arrow 79*b*. As can be seen in FIG. 4, such movement of gear rack 78 is impeded by the combined action of striker cam 24 and the interaction of drive gear 94 with gear rack 78, which provides an opposing force to that being imparted by extendible member 86.

Figure 6:
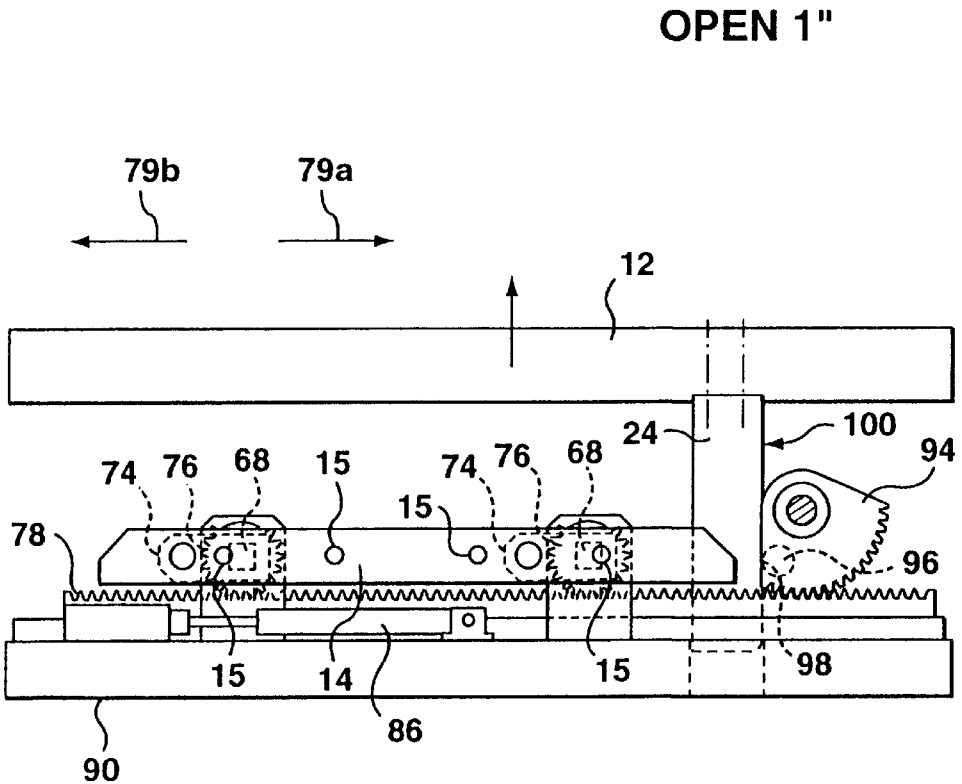
FIG. 6 is a front elevation view, partly in section, illustrating an embodiment of a transfer apparatus of the present invention illustrated in a first intermediate open position.

Drive gear 94 is urged into counterclockwise movement (for example, as shown in FIGS. 4 and 6) due to the cam surface 100 of the striker cam 24 engaging the contact surface 98 on the cam follower 96, so that the striker cam 24 causes the cam follower 96 to move in the direction of arrow 79*a* (as shown in FIG. 4) when the striker cam 24 moves downwardly with the press ram 12. In the embodiment shown, drive gear 94 is an oscillating quadrant gear including peripheral teeth 95 engaging gear rack 78. Drive gear 94 is mounted for rotation about shaft 93 extending between upstanding support plates 97*a* and 97*b*. As can be seen in FIG. 4, drive gear 94 meshes with gear rack 78 such that counterclockwise rotation of drive gear 94 imparts forces to gear rack 78, overcoming those being imparted by extendible member 86. As such, and as can be seen in FIG. 4, counterclockwise rotation of drive gear 94 causes linear movement of gear rack 78 in direction 79*a*, thereby permitting gear rack 78 to assume a second position longitudinally displaced in the direction denoted by directional arrow 79*a* along substantially the same horizontal plane from the above-described first position of gear rack 78.

Longitudinal movement of gear rack 78 causes rotation of each gear 76 and corresponding drive shaft 68 which leads to vertical displacement of finger bar 14. In one embodiment, longitudinal movement of gear rack 78 occurs within a plane substantially orthogonal to that defined by the axes 69 of drive shafts 68. Longitudinal movement of gear rack 78 in the direction denoted by directional arrow 79*a* results in arcuate travel of finger bar 14 above the plane of die stations 18 in the direction denoted by directional arrow 79*b*. Similarly, longitudinal movement of gear rack 78 in the direction denoted by directional arrow 79*b* results in arcuate travel by finger bar 14 above the die stations 18 in the direction denoted by directional arrow 79*a*.

Figure 18:
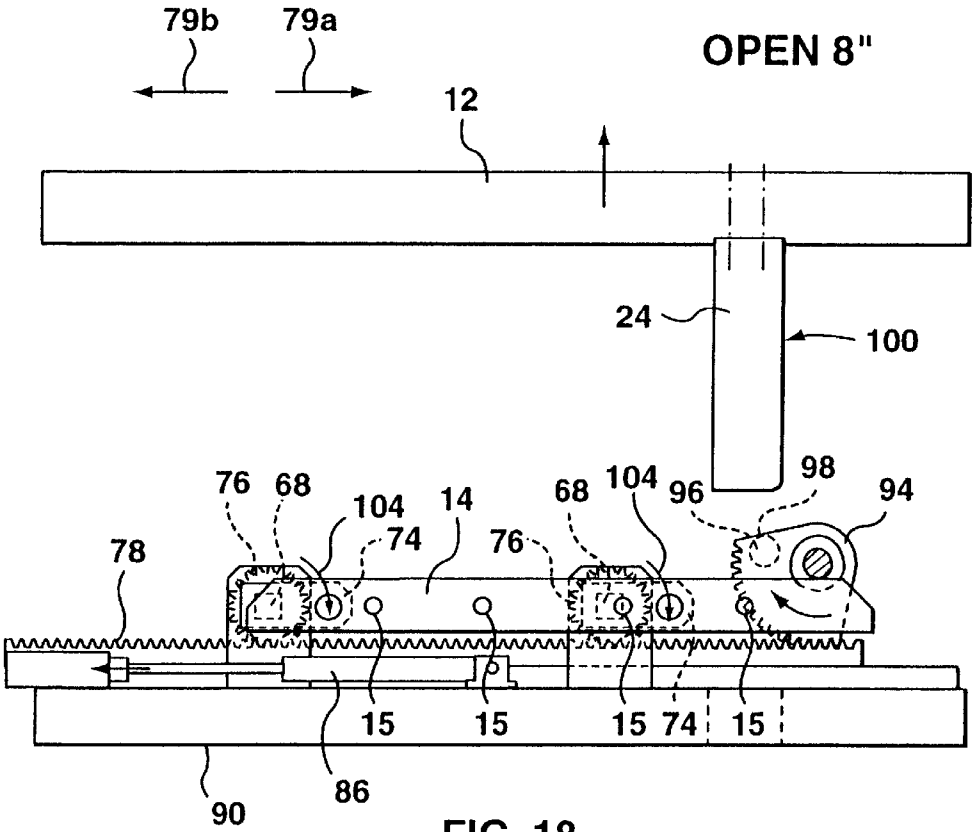
FIG. 18 is a front elevation view, partly in section, illustrating an embodiment of a transfer apparatus of the present invention illustrated in a seventh intermediate open position.
Figure 20:
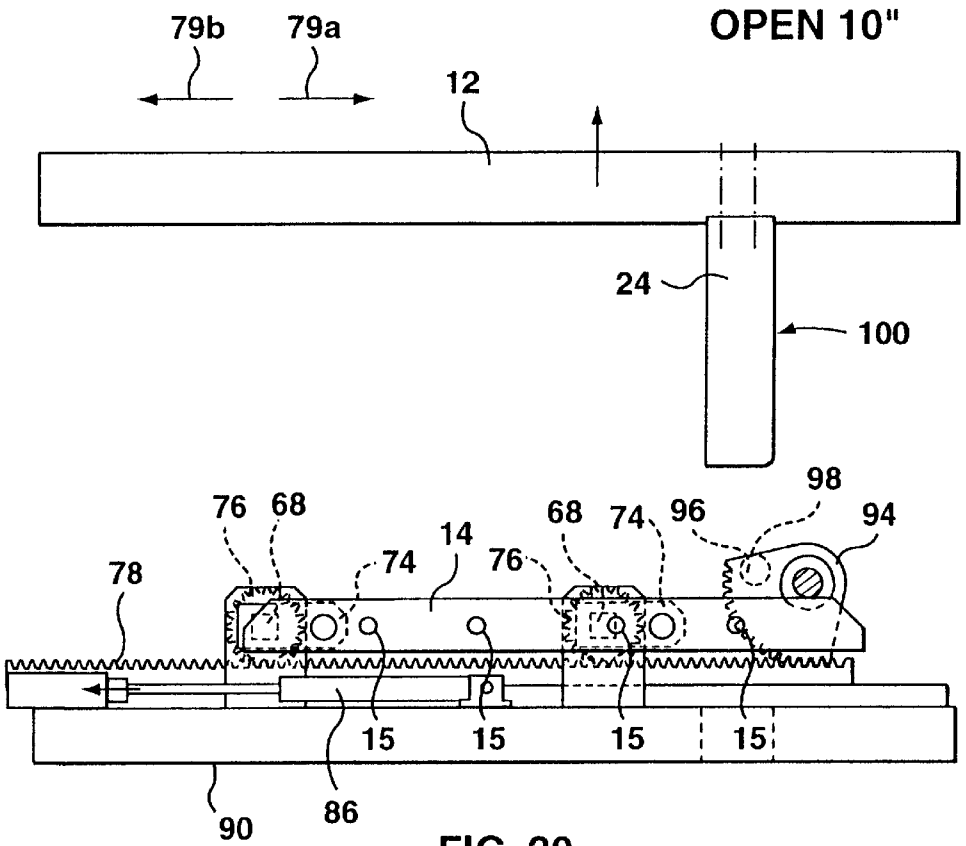
FIG. 20 is a front elevation view, partly in section, illustrating an embodiment of a transfer apparatus of the present invention illustrated in an eighth intermediate open position.
Figure 22:
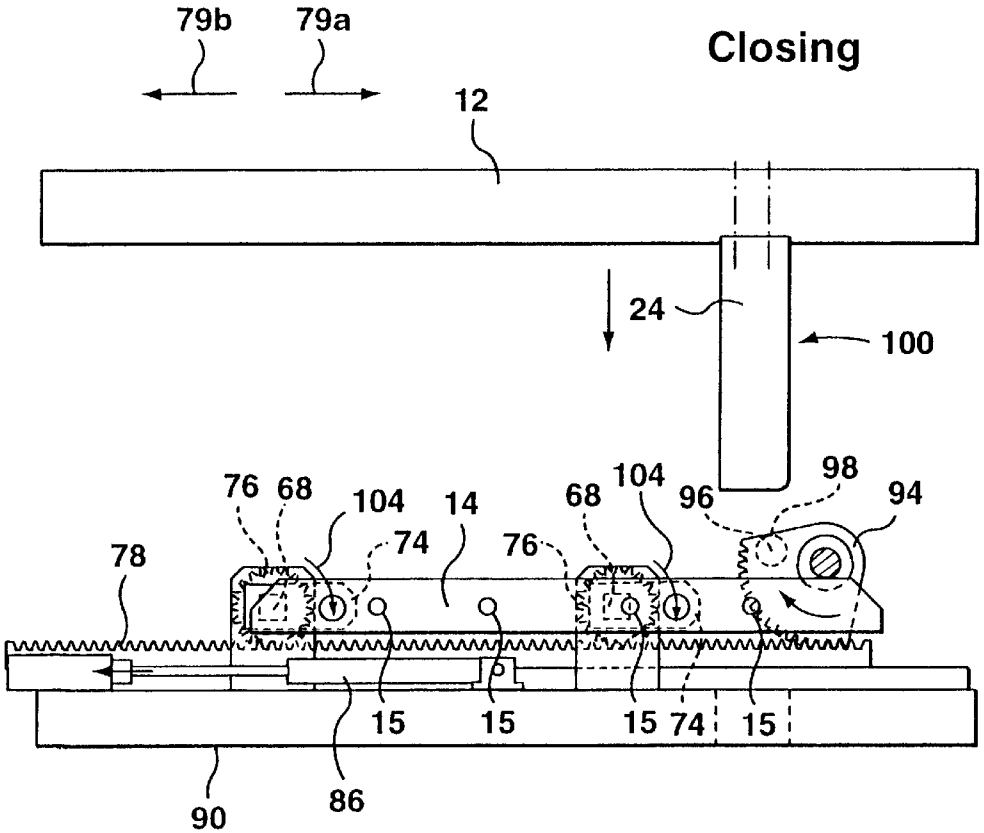
FIG. 22 is a front elevation view, partly in section, illustrating an embodiment of a transfer apparatus of the present invention illustrated in a ninth intermediate open position.
Figure 24:
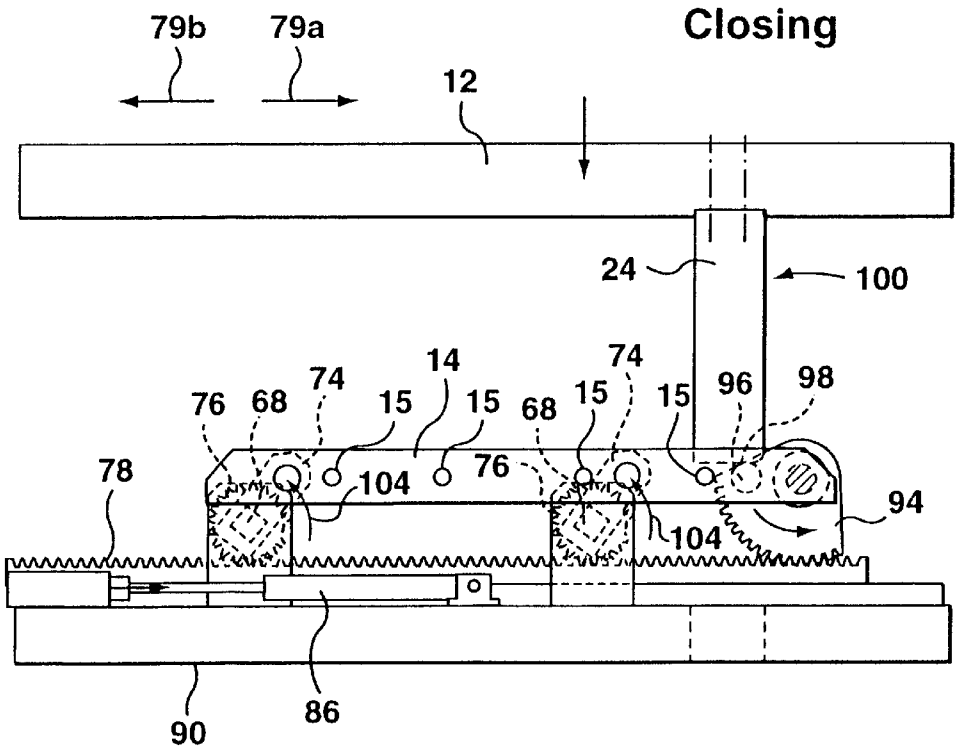
FIG. 24 is a front elevation view, partly in section, illustrating an embodiment of a transfer apparatus of the present invention illustrated in a tenth intermediate open position.

When the striker cam 24 is in the position shown in FIGS. 4, 6, 8, 10, and 12, it holds the cam follower 96 stationary, so that the cam follower 96 acts as a detent, serving to hold the drive gear 94 stationary. In the embodiment illustrated in FIG. 3, drive gear 94 includes eccentrically mounted cam follower 96 for engagement with striker cam 24. Cam follower 96 includes contact surface 98, adapted for engagement with cam surface 100 of striker cam 24. In this respect, and as can be seen in FIGS. 24 and 26 striker cam 24 urges counterclockwise rotation of drive gear 94 as striker cam 24 descends with press ram 12 and presses upon contact surface 98. Because the gear rack 78 is biased to the position in which it is shown in FIGS. 18, 20, and 22 by the extendible member 86, as the striker cam 24 is moved upwardly by the press ram 12, the drive gear 94 is gradually permitted to rotate in a clockwise direction (as shown in FIGS. 10, 12, 14, 16, and 18). Rotary motion of drive gear 94 is translated to linear movement of gear rack 78 which ultimately causes vertical displacement of finger bar 14 as described above.

Each of bearing blocks 71 and 70, bearing blocks 80 and 82, support plates 97*a* and 97*b*, and extendible member 86 is supported by support surface 90. Support surface 90 further includes a slot 89 for facilitating vertical travel of linear cam 22 therethrough.

Operation of die transfer apparatus 10 will now be described with reference to FIGS. 3 to 26. Beginning with FIGS. 3 and 4, press ram 12 is shown in a fully closed position wherein workpiece 16 is pressed between upper die 13*a* of press ram 12 and lower die 13*b* of die station 18. In this position, linear cam 22 is disposed in its lowermost position with cam follower 46 disposed against the upper end 34 of outer slot segment 28. Striker cam 24 is similarly disposed in its lowermost position, presenting an opposing cam surface 100 to that of contact surface 98 of drive gear 94. In particular, opposing surface 100 is in contact with contact surface 98, so that striker cam 24 acts as a detent, preventing rotation of drive gear 94. As such, gear rack 78 and, therefore, gears 76 are maintained in a stationary position. In this position, finger bar 14 is retracted from but vertically aligned for engagement with workpieces 16.

Figure 5:
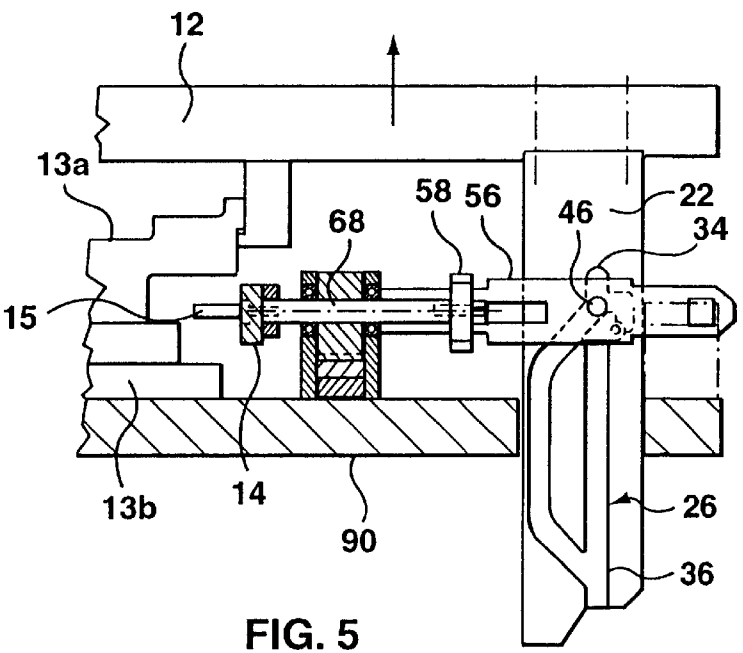
FIG. 5 is a side elevation view, partly in section, illustrating an embodiment of a transfer apparatus of the present invention illustrated in a first intermediate open position.

FIGS. 5 and 6 illustrate transfer apparatus 10 in a first intermediate open position. Linear cam 22 has moved upwardly from its lowermost position such that cam follower 46 is guided by outer slot segment 28 to rest against bridge 44 without moving laterally relative to its position in FIG. 3. As such, pusher arm 56 and finger bar 14 have maintained stationary positions relative to their respective positions in FIG. 5. Referring to FIG. 6, striker cam 24 has moved upwardly but continues to remain oriented in contact with drive gear 94 as in FIG. 4, thereby maintaining drive gear 94 in a stationary position. As such, rotation of drive gear 94 is prevented, thereby maintaining gear rack 78 and, therefore, gears 76 in a stationary position as above-described.

Figure 7:
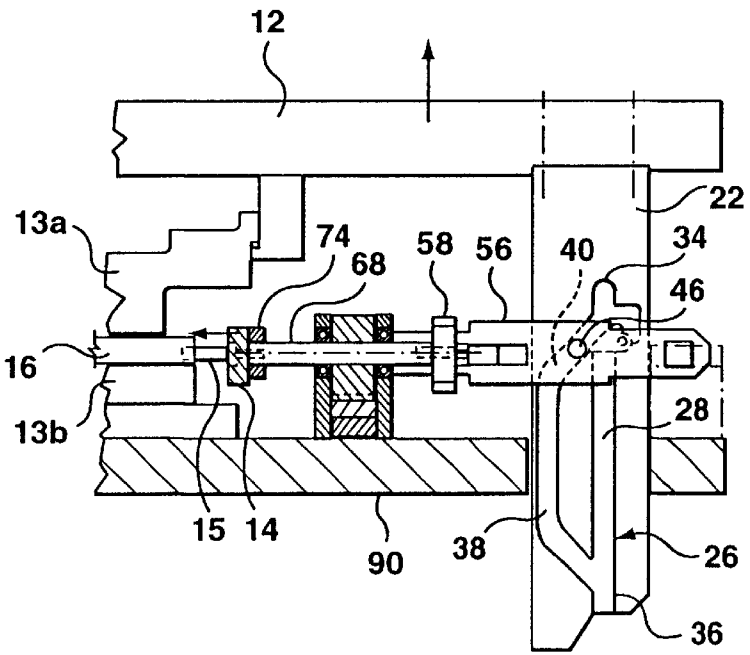
FIG. 7 is a side elevation view, partly in section, illustrating an embodiment of a transfer apparatus of the present invention illustrated in a second intermediate open position.
Figure 8:
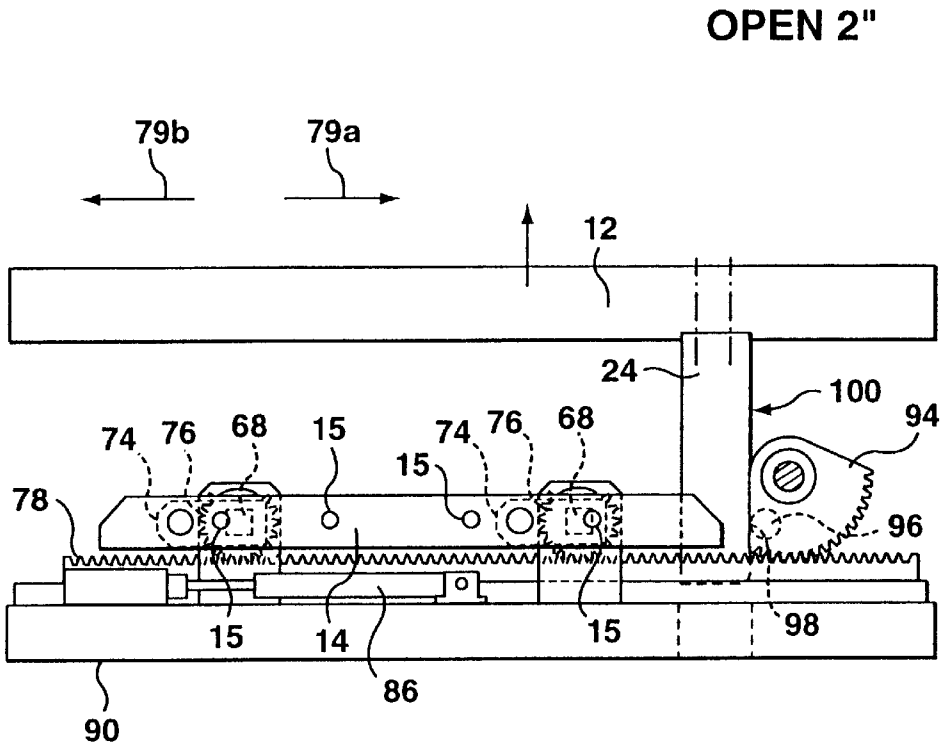
FIG. 8 is a front elevation view, partly in section, illustrating an embodiment of a transfer apparatus of the present invention illustrated in a second intermediate open position.

FIGS. 7 and 8 illustrate transfer apparatus 10 in a second intermediate open position. Linear cam 22 has further moved upwardly relative to its position in FIG. 5. Simultaneously, cam follower 46 has become disposed in first inclined inner slot portion 40 of inner slot segment 30. In this respect, cam follower 46 has moved laterally relative to its positions in FIGS. 3 and 5, thereby urging pusher arm 56 and finger bar 14 forwardly towards workpieces 16. Referring to FIG. 8, striker cam 24 continues to move upwardly and act as a detent, preventing rotation of drive gear 94, thereby maintaining gear rack 78 and, therefore, gears 76 in a stationary position as in FIGS. 4 and 6.

Figure 9:
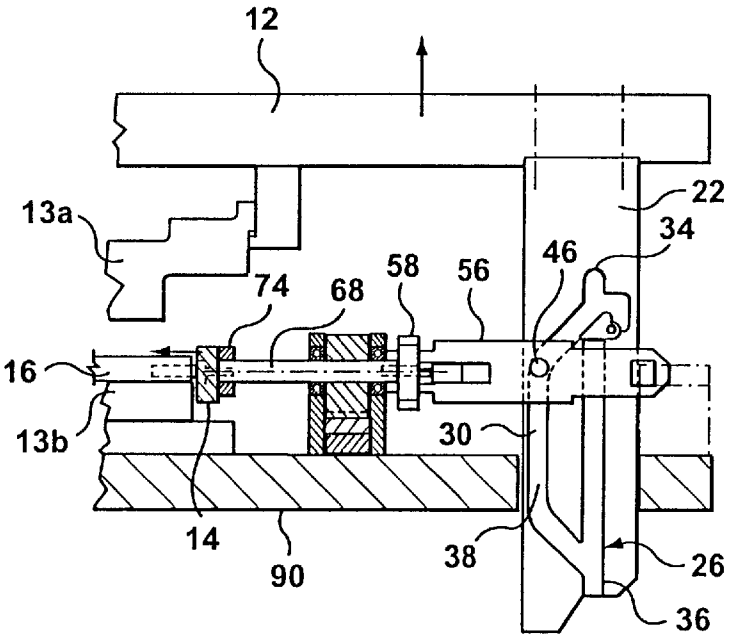
FIG. 9 is a side elevation view, partly in section, illustrating an embodiment of a transfer apparatus of the present invention illustrated in a third intermediate open position.
Figure 10:
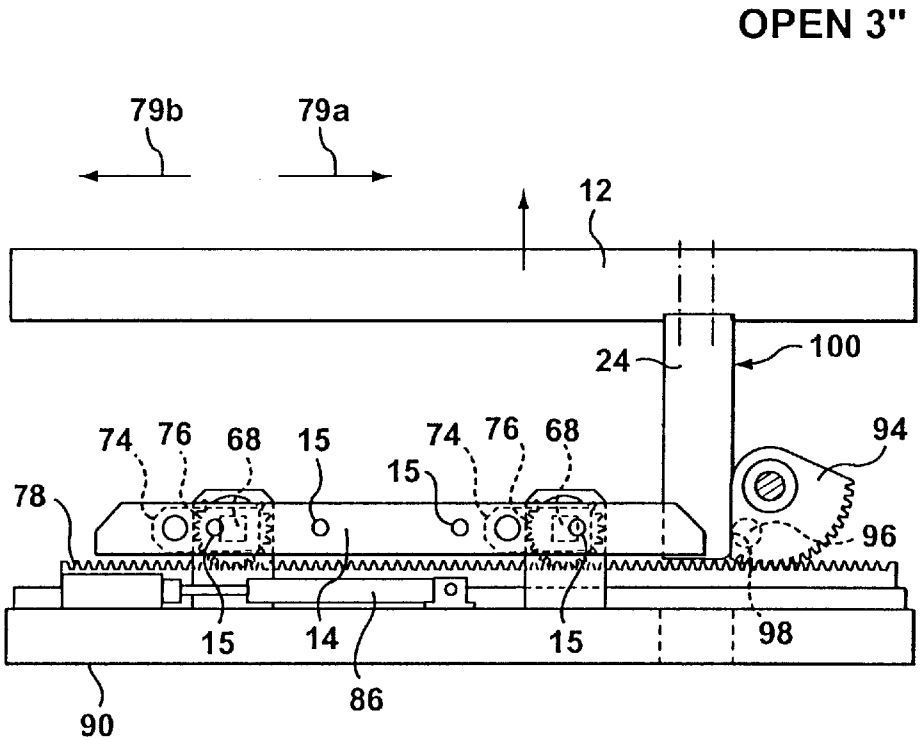
FIG. 10 is a front elevation view, partly in section, illustrating an embodiment of a transfer apparatus of the present invention illustrated in a third intermediate open position.

FIGS. 9 and 10 illustrate transfer apparatus 10 in a third intermediate open position. In this position, and referring to FIG. 9, upper die 13*a* has retracted from workpieces 16 relative to its position in FIG. 7. Linear cam 22 has further moved upwardly relative to its position in FIG. 7. Simultaneously, cam follower 46 has become disposed in vertical inner slot portion 38 of inner slot segment 30. In this respect, cam follower 46 has moved laterally relative to its position in FIG. 7 and, as a result, urges finger bar 14 into a workpiece engagement position. Striker cam 24 continues to move upwardly and act as a detent, preventing rotation of drive gear 94, thereby maintaining gear rack 78 and, therefore, gears 76 in a stationary position as in FIGS. 4, 6, and 8.

Figure 11:
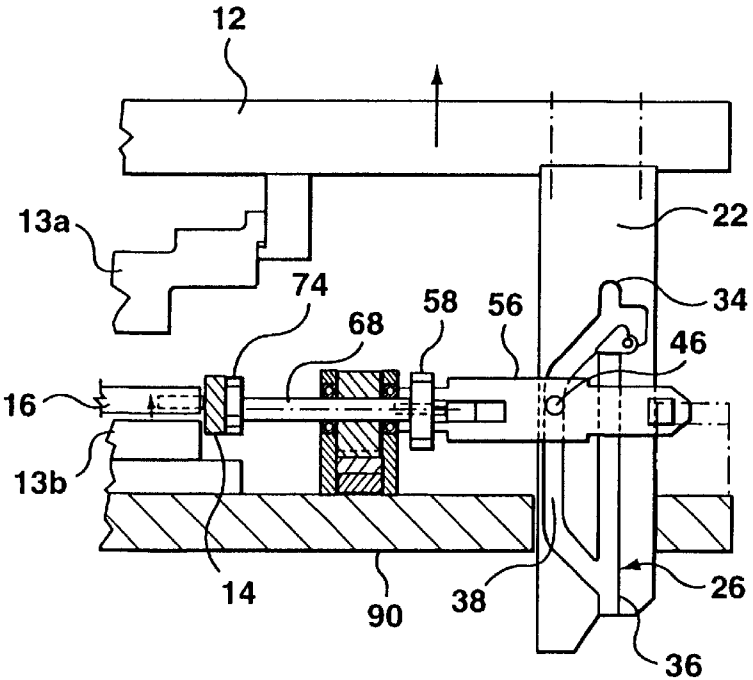
FIG. 11 is a side elevation view, partly in section, illustrating an embodiment of a transfer apparatus of the present invention illustrated in a fourth intermediate open position.
Figure 12:
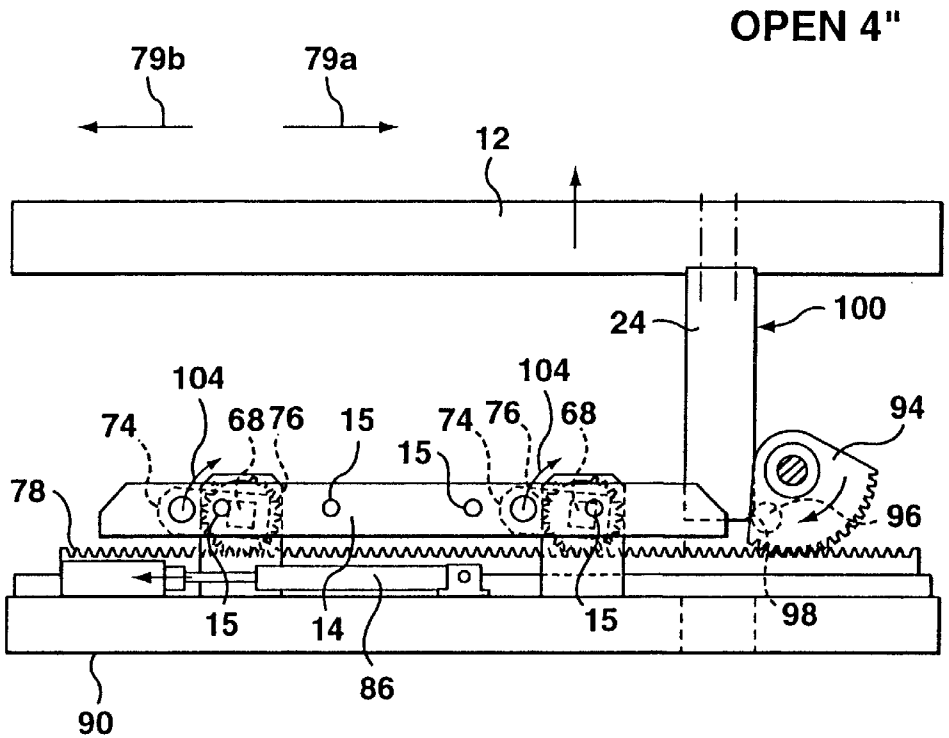
FIG. 12 is a front elevation view, partly in section, illustrating an embodiment of a transfer apparatus of the present invention illustrated in a fourth intermediate open position.

FIGS. 11 and 12 illustrate transfer apparatus 10 in a fourth intermediate open position. In this position, upper die 13*a* has further retracted from workpieces 16 relative to its position in FIG. 9. Linear cam 22 has further moved upwardly relative to its position in FIG. 9. As the linear cam 22 has moved further upwardly, the cam follower 46 is guided by the vertical inner slot portion 38 so that the cam follower 46 has maintained its lateral position. In response, finger bar 14 has maintained its workpiece engagement position of FIG. 9. As shown in FIG. 12, striker cam 24 has continued to move upwardly from its position in FIG. 10, permitting limited clockwise rotation of drive gear 94 from its position in FIG. 10. As a result, gear rack 78 has moved longitudinally upon linear bearing 84 in the direction denoted by directional arrow 79*b*, with consequent rotation of gears 76 in a clockwise direction as denoted by directional arrows 104. Rotation of gears 76 imparts torque to respective drive shafts 68, simultaneously causing finger bar 14 to undergo both upwards vertical displacement and longitudinal displacement in the direction of directional arrow 79*a* relative to its positions illustrated in FIGS. 4, 6, 8, and 10. As a result, finger bar 14 begins upwardly arcuate travel in the direction of directional arrow 79*a*.

Figure 13:
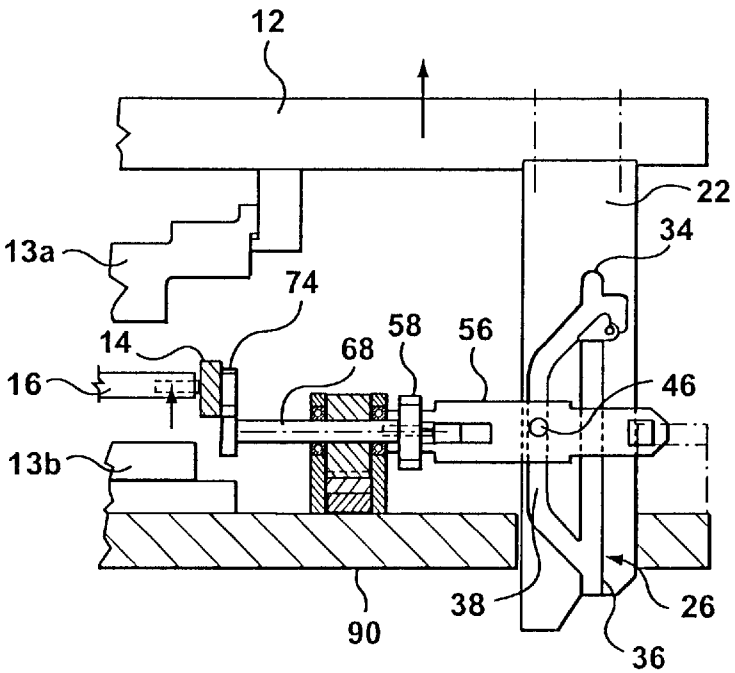
FIG. 13 is a side elevation view, partly in section, illustrating an embodiment of a transfer apparatus of the present invention illustrated in a fifth intermediate open position.
Figure 14:
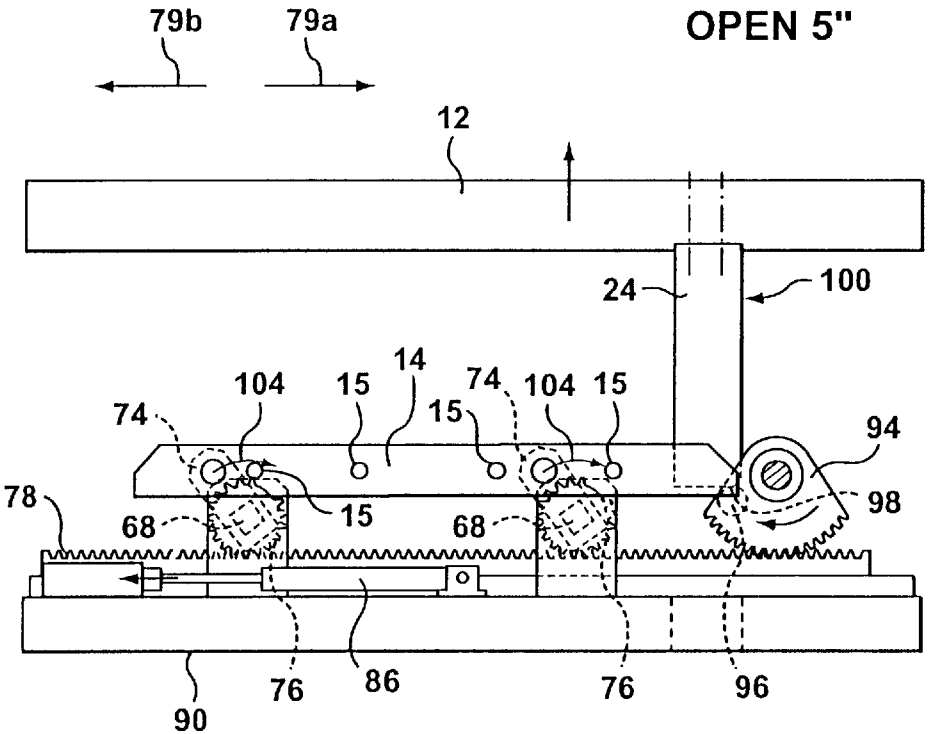
FIG. 14 is a front elevation view, partly in section, illustrating an embodiment of a transfer apparatus of the present invention illustrated in a fifth intermediate open position.

FIGS. 13 and 14 illustrate transfer apparatus 10 in a fifth intermediate open position. In this position, upper die 13*a* has further retracted from workpieces 16 relative to its position in FIG. 11. Linear cam 22 has further moved upwardly relative to its position in FIG. 11. As the linear cam 22 has moved further upwardly, the cam follower 46 is guided by the vertical inner slot portion 38 so that the cam follower 46 has maintained its lateral position. As a consequence, finger bar 14 continues to maintain its workpiece engagement position of FIGS. 9 and 11. Striker cam 24 has continued to move upwardly from its position in FIG. 12, thereby permitting further rotation of drive gear 94 from its position in FIG. 12. Gear rack 78 continues to move longitudinally upon linear bearing 84 from its position in FIG. 12 in the direction denoted by directional arrow 79*b*. As can be seen in FIG. 14, the extendible member 86 causes movement of the gear rack 78 in the direction of the arrow 79*b*, and this movement of the gear rack 78 causes the gears 76 to rotate about the axes 69. Rotation of the gears 76 in the clockwise direction, as shown in FIG. 14, in turn causes the drive shafts 68 to rotate about the axes 69 in the clockwise direction, causing the linkages 74 to raise the finger bar 14 and to move the finger bar 14 in an arcuate path and generally in the direction of the arrow 79*a*. In response, finger bar 14 continues upwardly arcuate travel in the direction of directional arrow 79*a*, moving upwards and longitudinally from its position in FIG. 12.

Figure 15:
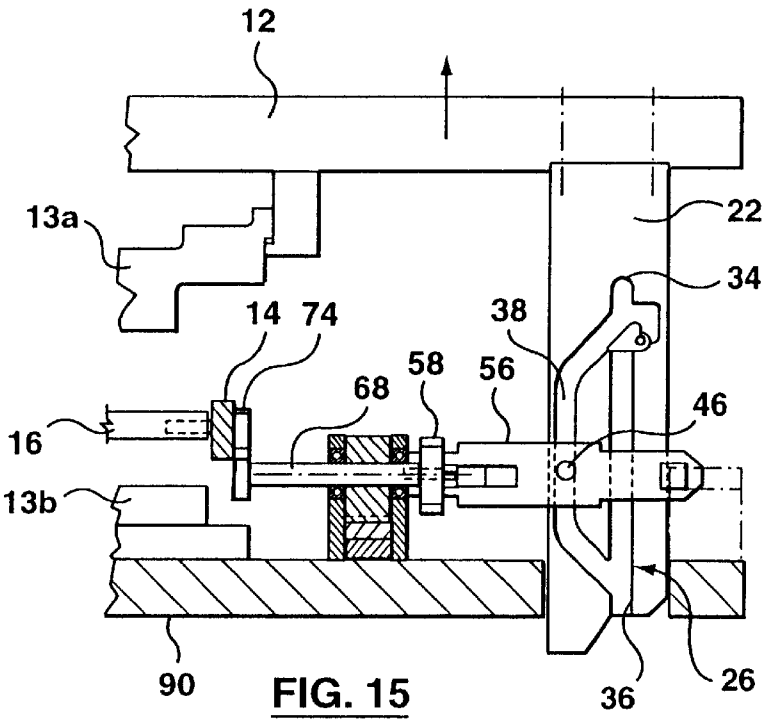
FIG. 15 is a side elevation view, partly in section, illustrating an embodiment of a transfer apparatus of the present invention illustrated in a sixth intermediate open position.
Figure 16:
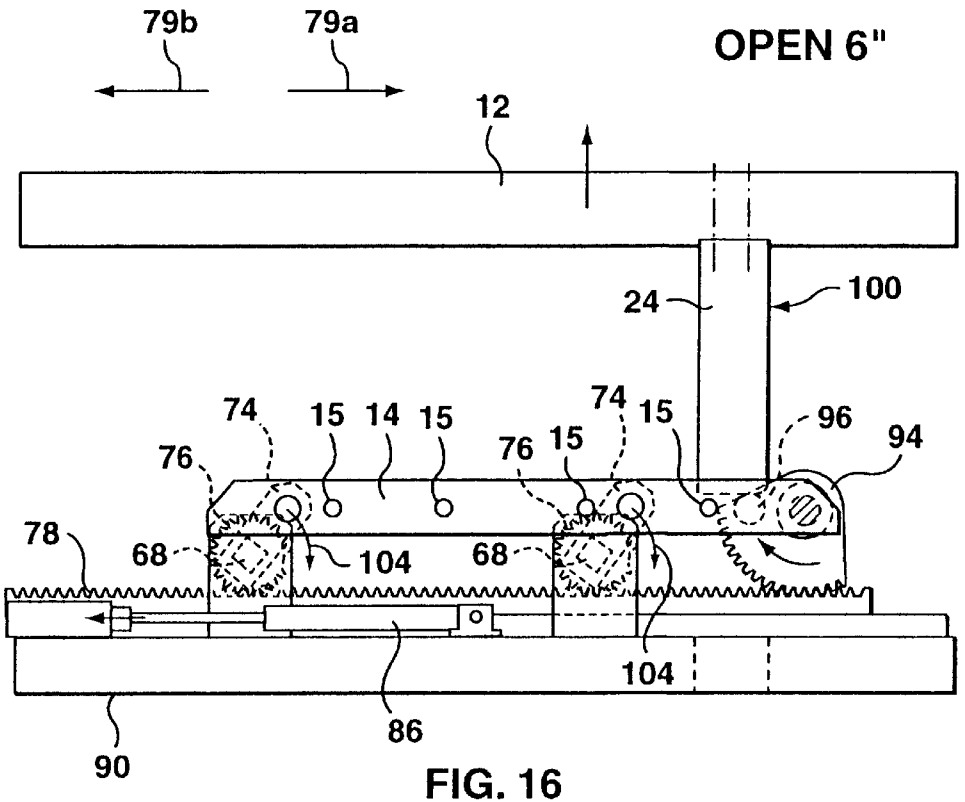
FIG. 16 is a front elevation view, partly in section, illustrating an embodiment of a transfer apparatus of the present invention illustrated in a sixth intermediate open position.

FIGS. 15 and 16 illustrate transfer apparatus 10 in a sixth intermediate open position. In this position, upper die 13*a* has further retracted from workpieces 16 relative to its position in FIG. 13. Linear cam 22 has further moved upwardly relative to its position in FIG. 13. As the linear cam 22 has moved further upwardly, the cam follower 46 is guided by the vertical inner slot portion 38 so that the cam follower 46 has maintained its lateral position. Finger bar 14 continues to maintain its workpiece engagement position of FIGS. 9, 11, and 13. Striker cam 24 has continued to move upwardly from its position in FIG. 14, thereby permitting further rotation of drive gear 94 from its position in FIG. 14. Gear rack 78 continues to move longitudinally upon linear bearing 84 from its position in FIG. 14 in the direction denoted by directional arrow 79*b*. Gears 76 further rotate from their positions in FIG. 13 in a clockwise direction as denoted by directional arrows 104, as shown in FIG. 15. As a result, torque continues to be imparted to drive shafts 68 by respective gears 76. In response, finger bar 14 continues arcuate travel in an upward direction, through its vertically highest position, and then continues arcuate travel but in a downwardly direction.

Figure 17:
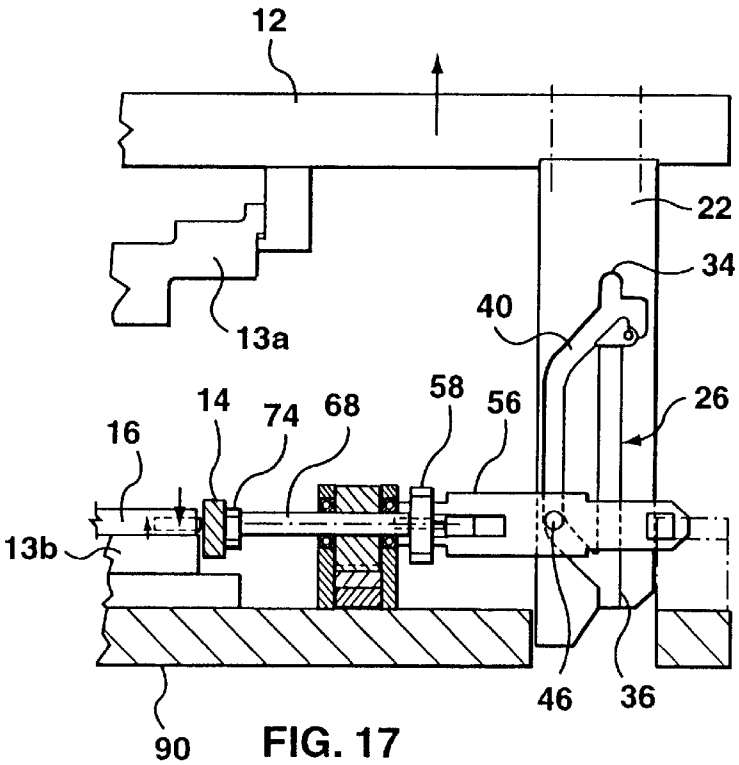
FIG. 17 is a side elevation view, partly in section, illustrating an embodiment of a transfer apparatus of the present invention illustrated in a seventh intermediate open position.

FIGS. 17 and 18 illustrate transfer apparatus 10 in a seventh intermediate open position. In this position, upper die 13*a* has further retracted from workpiece 16 relative to its position in FIG. 15. Linear cam 22 has further moved upwardly relative to its position in FIG. 15. As the linear cam 22 has moved further upwardly, the cam follower 46 is guided by the vertical inner slot portion 38 so that the cam follower 46 maintained its lateral position. In response, finger bar 14 continues to maintain its workpiece engagement position of FIGS. 9, 11, 13, and 15. Striker cam 24 has continued to move upwardly from its position in FIG. 16, such that forces imparted by extendible member 86, urging the gear rack 78 in the direction of the arrow 79*b*, are unopposed. In this respect, striker cam 24 has retracted from drive gear 94 and unable to provide any opposing force to that being imparted to drive gear 94 by gear rack 78. As a result, gear rack 78 freely moves longitudinally in the direction denoted by directional arrow 79*b* from its position in FIG. 16 upon urging by extendible member 86 until extendible member 86 assumes its fully extended position as illustrated in FIG. 18, at which point gear rack 78 can no longer further move longitudinally in the direction denoted by directional arrow 79*b*. In response, gears 76 have further rotated from their positions in FIG. 16 in a clockwise direction as denoted by directional arrows 104. As a result, torque has continued to have been imparted to drive shafts 68 by respective gears 76. This has caused finger bar 14 to continue its arcuate travel in the general direction of directional arrow 79*a* but in a downward direction until finger bar 14 assumes its vertically lowermost position, which is illustrated in FIG. 18. Contemporaneously, finger bar 14 has now indexed workpiece 16 to the next in-line die station 19 which is disposed longitudinally from die station 18 in the general direction of directional arrow 79*a*.

Figure 19:
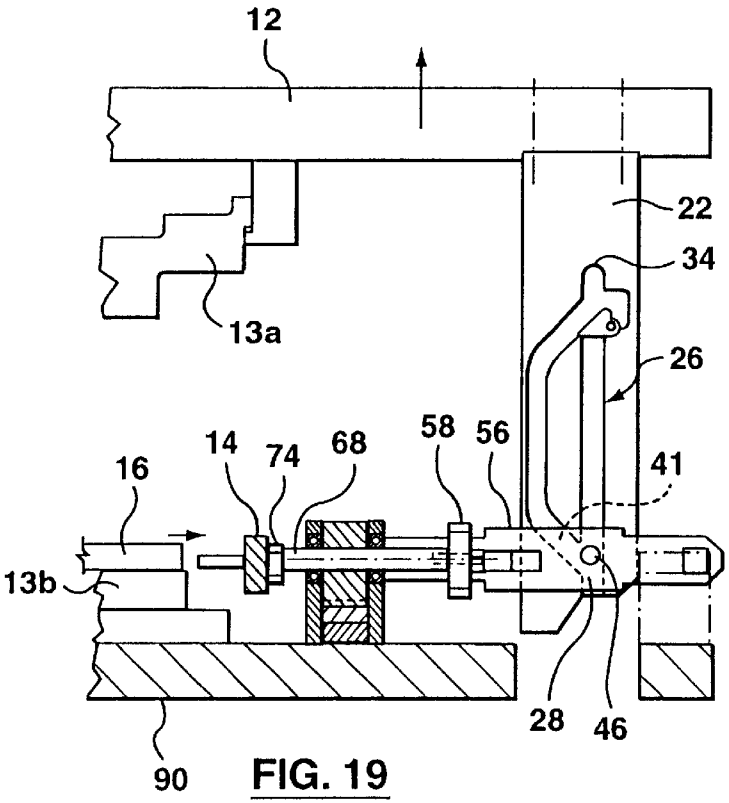
FIG. 19 is a side elevation view, partly in section, illustrating an embodiment of a transfer apparatus of the present invention illustrated in an eighth intermediate open position.

FIGS. 19 and 20 illustrate transfer apparatus 10 in an eighth intermediate open position. Transfer apparatus 10 has now reached its fully open position. In this position, upper die 13*a* has further retracted from workpiece 16 relative to its position in FIG. 17. Striker cam 24 remains retracted from drive gear 94. Linear cam 22 has further moved upwardly relative to its position in FIG. 17. As the linear cam 22 moves further upwardly, the cam follower 46 is guided by the second inclined inner slot portion 41 so that the cam follower 46 is guided by the second inclined inner slot portion 41 to enter the outer slot segment 28. In response, finger bar 14 has retracted from workpiece 16, thereby assuming a fully retracted position.

Figure 21:
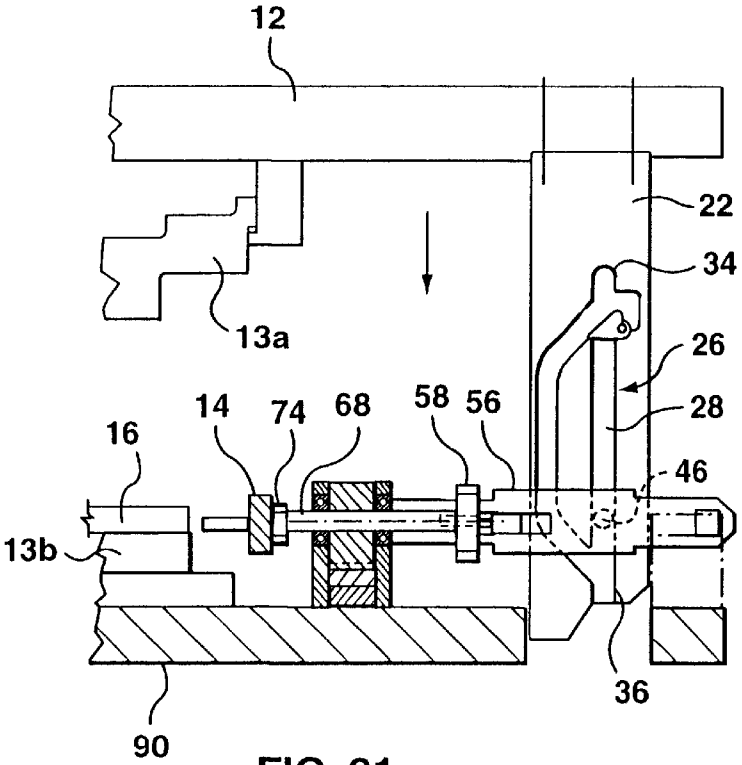
FIG. 21 is a side elevation view, partly in section, illustrating an embodiment of a transfer apparatus of the present invention illustrated in a ninth intermediate open position.

FIGS. 21 and 22 illustrate transfer apparatus 10 in a ninth intermediate open position. In this position, upper die 13*a* has ceased further upward travel and has begun descending towards and approaching workpiece 16. Striker cam 24 also begins approaching drive gear 94, but remains spaced apart from drive gear 94. Linear cam 22 has moved downwardly relative to its position. As the linear cam 22 moves further downwardly, the cam follower 46 is guided by the outer slot segment 28 without changing its lateral position in FIG. 19. As a result, finger bar 14 remains fully retracted from workpiece 16 as in FIG. 19.

Figure 23:
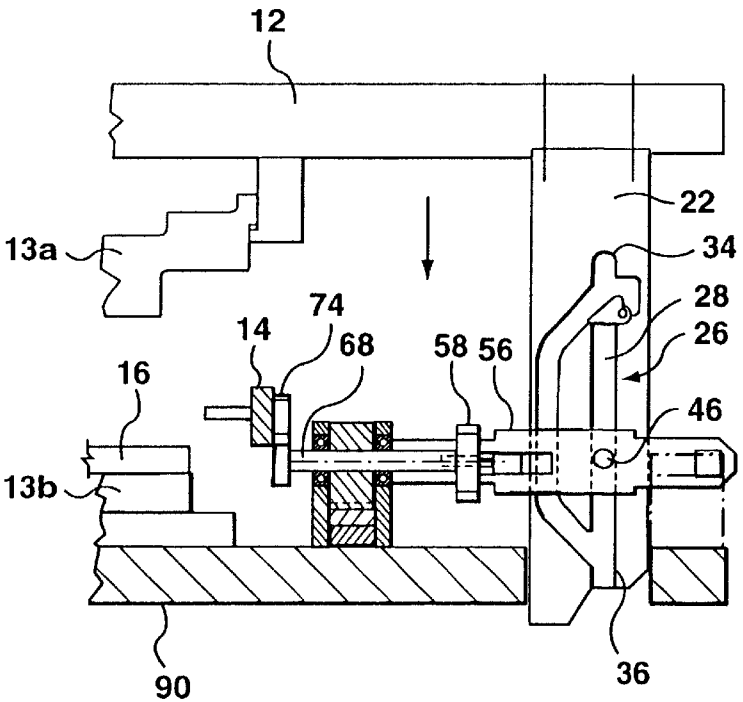
FIG. 23 is a side elevation view, partly in section, illustrating an embodiment of a transfer apparatus of the present invention illustrated in a tenth intermediate open position.

FIGS. 23 and 24 illustrate transfer apparatus 10 in a tenth intermediate open position. In this position, upper die 13*a* has continued to descend and approach workpiece 16. Striker cam 24 has also continued to descend, causing cam surface 100 to come in contact with contact surface 98, thereby urging drive gear 94 to rotate in a counterclockwise manner, as shown in FIG. 24, from its position in FIG. 22. This causes gear rack 78 to move longitudinally upon linear bearing 84 from its position in FIG. 22 in the direction denoted by directional arrow 79*a*. In response, gears 76 rotate from their positions in FIG. 24 in a counterclockwise direction as denoted by directional arrows 104. As a result, torque is imparted to drive shafts 68 by respective gears 76 and finger bar 14 assumes arcuate travel in the direction of directional arrow 79*b*, while also moving upwardly (relative to its position in FIG. 21) above the plane of lower die 13*b* to assume the position illustrated in FIG. 23. The linear cam 22 continues to move downwardly, and the cam follower 46 is guided by the outer slot segment 28 without changing its lateral position.

FIGS. 25 and 26 illustrate transfer apparatus 10 in an eleventh intermediate open position. Relative to its position in FIG. 23, upper die 13*a* has continued to descend towards and approach workpiece 16. Striker cam 24 has continued to press upon drive gear 94 until drive gear 94 has rotated sufficiently in a counterclockwise direction, as shown in FIG. 16, that the striker cam follower 96 does not directly impede the downward travel of the striker cam 24, the contact surface 98 of the cam follower 96 remaining in contact with the cam surface 100 of the striker cam 24. This causes gear rack 78 to continue to move longitudinally upon linear bearing 84 from its position in FIG. 24 in the direction denoted by directional arrow 79*a*. In response, gears 76 further rotate from their positions in FIG. 24 in a counterclockwise direction as denoted by directional arrows 104. As a result, torque continues to be imparted to drive shafts 68 by respective gears 76, and finger bar 14 continues arcuate travel in the direction of directional arrow 79*b*, while passing through its highest point of travel and then descending towards the plane of lower die 13*b*. When finally assuming its position illustrated in FIG. 25, finger bar 14 is substantially horizontally aligned relative to the workpiece 16 at the first die station 18. Simultaneous with finger bar 14 assuming this position, the contact surface 98 remains engaged with the cam surface 100 and the drive gear 94 does not rotate in a further counterclockwise direction, as shown in FIG. 26, so that further travel of gear rack 78 in the direction of directional arrow 79*a* has also ceased. Striker cam 24 presents an opposing cam surface 100 to that of contact surface 98 of drive gear 94, the striker cam 24 acting as a detent. Linear cam 22 has continued to move downwardly relative to its position in FIG. 13. As the linear cam 22 moves downwardly, the cam follower 46 is guided by outer slot segment 28 without changing its lateral position. As a result, finger bar 14 remains fully retracted from workpiece 16 as in FIGS. 19, 21, and 23. In the position illustrated in FIG. 25, cam follower 46 has begun urging bridge 44 to rotate upwardly to permit the cam follower 46 to be guided along the outer slot segment 28.

This eleventh intermediate open position immediately precedes the position of transfer apparatus 10 illustrated in FIGS. 3 and 4. Therefore, FIGS. 3–26 illustrate one complete cycle of operation of transfer apparatus 10, whereby transfer apparatus 10 effects the indexing of a workpiece 16 from a first die station 18 to the next longitudinally in-line die station 19 and then returns to pick up a second workpiece 16 which has now become disposed at the first die station 18.

Although the disclosure describes and illustrates preferred embodiments of the invention, it is to be understood that the invention is not limited to these particular embodiments. Many variations and modifications will now occur to those skilled in the art. For definition of the invention, reference is to be made to the appended claims.

I claim:

1. A transfer apparatus for transferring workpieces between die stations, the transfer apparatus comprising:

a press ram;

a striker cam operatively driven by the press ram;

a rotary gear adapted to be rotated in response to movement of the striker cam;

a drive shaft extending from the rotary gear and characterized by a distal end; and a finger bar coupled to the distal end of the drive shaft and pivotally mounted to assume arcuate travel above the die stations in response to rotation of the rotary gear.

2. The transfer apparatus as claimed in claim 1 wherein the drive shaft extends through a throughbore provided within the rotary gear, the drive shaft being movable in a lateral direction in response to movement of a pusher arm in the lateral direction.

3. The transfer apparatus as claimed in claim 2 wherein the pusher arm is movable in response to movement of the press ram.

4. The transfer apparatus as claimed in claim 3 wherein a linear cam is provided to urge lateral motion of the pusher arm in response to movement of the press ram, and wherein the linear cam is operatively driven by the press ram.

5. The transfer apparatus as claimed in claim 4 wherein the linear cam includes an inner vertical slot, the inner vertical slot including an inner vertical slot upper end and an inner vertical slot lower end, an outer vertical slot including an outer vertical slot upper end and an outer vertical slot lower end, wherein the inner vertical slot upper end and the outer vertical slot upper end are joined by an upper inclined slot, and wherein the inner vertical slot lower end and the outer vertical slot lower end are joined by a lower inclined slot, the transfer apparatus additionally including a cam follower extending from the pusher arm and disposed within the slots provided in the linear cam, such that the cam follower is guided in the lateral direction as the press ram moves upwardly while the cam follower is disposed within the upper inclined slot and the lower inclined slot.

6. The transfer apparatus as claimed in claim 5 wherein the upper inclined slot is inclined from the inner vertical slot to the outer vertical slot at an angle of inclination above the horizontal, and wherein the lower inclined slot is inclined from the inner vertical slot to the outer vertical slot at an angle of inclination below the horizontal.

7. The transfer apparatus as claimed in claim 1 wherein the transfer apparatus additionally includes a linkage having a first end and a second end, the first end being coupled to the distal end of the drive shaft, the second end being pivotally mounted to the finger bar.

8. The transfer apparatus as claimed in claim 7 wherein the press ram is movable between a fully open position and a fully closed position, and wherein the rotary gear is urged to rotate in response to movement by the striker cam as the press ram moves between the fully open position and the fully closed position.

9. The transfer apparatus as claimed in claim 8 further comprising:

a drive gear rotatable about a drive gear axis and having peripheral teeth, the drive gear being positioned apart from the rotary gear in a longitudinal direction;

a gear rack extending between the rotary gear and the drive gear, the gear rack including upstanding teeth; and the rotary gear including rotary gear teeth disposed on the periphery of the rotary gear;

wherein the upstanding teeth of the gear rack mesh with the peripheral teeth and the rotary gear teeth, such that rotation of the rotary gear in the longitudinal direction is caused by movement of the gear rack in response to rotation of the drive gear.

10. The transfer apparatus as claimed in claim 9 wherein the drive gear includes a drive gear cam follower mounted eccentrically relative to the drive gear axis, the drive gear having a contact surface for engagement with the striker cam.

11. The transfer apparatus as claimed in claim 10 wherein the drive gear is a quadrant gear.

12. The transfer apparatus as claimed in claim 11 additionally comprising an extendible member, wherein the gear rack is movable in the longitudinal direction between a first longitudinal position and a second longitudinal position, and wherein the gear rack assumes the second longitudinal position when the press ram is moving from the fully open position to the fully closed position, and the gear rack is biased to the first longitudinal position by the extendible member.

13. A transfer apparatus for transferring workpieces between die stations comprising:

a press ram, movable between a fully open position and a fully closed position;

a linear cam mounted to and extending below the press ram, the linear cam including a guide slot;

a pusher arm movable in a lateral direction, the pusher arm including a cam follower extending therefrom, the cam follower being positioned within the guide slot to permit movement of the linear cam relative to the cam follower;

the guide slot including an inner vertical slot, the inner vertical slot including an inner vertical slot upper end and an inner vertical slot lower end, an outer vertical slot including an outer vertical slot upper end and an outer vertical slot lower end, wherein the inner vertical slot upper end and the outer vertical slot upper end are joined by an upper inclined slot, and wherein the inner vertical slot lower end and the outer vertical slot lower end are joined by a lower inclined slot, such that the linear cam is moved relative to the cam follower as the press ram moves between the fully open position and the fully closed position; and a finger bar, movable in the lateral direction in response to movement of the pusher arm in the lateral direction, such that the finger bar is moved into engagement and out of engagement with the workpieces.

14. The transfer apparatus as claimed in claim 13 wherein the upper inclined slot is inclined from the inner slot to the outer slot at an angle of inclination above the horizontal, and wherein the lower inclined slot is inclined from the inner slot to the outer slot at an angle of inclination below the horizontal.

15. The transfer apparatus as claimed in claim 14 wherein the linear cam further comprises a pivotal bridge disposed immediately below a point of connection between the outer vertical slot and the upper inclined slot.

16. The transfer apparatus as claimed in claim 15 wherein the bridge pivots to permit the cam follower to be guided along the outer vertical slot as the press ram moves from the fully open position to the fully closed position.

17. A transfer apparatus for transferring workpieces between die stations, the die stations being spaced from each other in a longitudinal direction, movement from a first die station to a successive die station being in a second longitudinal direction, the transfer apparatus having:

a support surface, the support surface being substantially horizontal and stationary;

a press ram positioned above the support surface, the press ram being movable substantially vertically between a fully closed position and a fully open position;

a striker cam mounted on and extending below the press ram;

a drive gear rotatable about a drive gear axis, the drive gear axis being substantially horizontal, the drive gear having an eccentrically mounted cam follower having a contact surface thereon for engagement with the striker cam, and the drive gear having peripheral teeth;

an elongate gear rack slidably mounted on the support surface for movement between a first gear rack position and a second gear rack position, the gear rack having gear rack teeth, the peripheral teeth being engagable with the gear rack teeth such that, when the press ram moves from the fully open position to the fully closed position, the striker cam engages the contact surface, causing the drive gear to rotate about the drive gear axis, thereby causing the peripheral teeth to engage the gear rack teeth and to urge the gear rack to move in the second longitudinal direction from the first gear rack position to the second gear rack position;

an extendible member having a first end fixedly mounted on the support surface, and a retractable second end connected to the gear rack, the extendible member biasing the gear rack to the first gear rack position, such that when the press ram is in the fully closed position, the gear rack is in the second gear rack position and the eccentrically mounted cam follower acts as a detent restraining the gear rack from moving in a first longitudinal direction to the first gear rack position, the first longitudinal direction being opposite to the second longitudinal direction, and when the press ram is in the open position, the gear rack is in the first gear rack position, movement of the press ram from the fully closed position to the fully open position resulting in the extendible member urging the gear rack from the second gear rack position to the first gear rack position;

at least one gear rotatable about a gear axis, the at least one gear axis being substantially parallel to a lateral direction, the lateral direction being substantially horizontal and orthogonal to the longitudinal direction, the at least one gear having gear teeth engaged with the gear rack teeth, such that movement of the gear rack in the first longitudinal direction and in the second longitudinal direction causes rotation of the at least one gear about the at least one gear axis, the at least one gear having a throughbore aperture;

at least one drive shaft, slidably received in the throughbore aperture, coaxial with the at least one gear and engagable with the at least one gear, such that rotation of the at least one gear about the at least one gear axis causes rotation of the at least one drive shaft, the at least one drive shaft having a second end positioned in the vicinity of the gear rack;

a finger bar; and at least one linkage for linking the second end of the at least one drive shaft to the finger bar, the at least one linkage being pivotally mounted to the finger bar at a point radially disposed from the at least one gear axis, the at least one linkage also being coupled to the second end of the at least one drive shaft, such that movement of the gear rack in the first longitudinal direction causes the finger bar to travel in an arcuate path and generally in the second longitudinal direction from the first die station to the successive die station, the workpiece remaining substantially vertical while travelling along the arcuate path, and movement of the gear rack in the second longitudinal direction causes the finger bar to travel in the arcuate path and generally in the first longitudinal direction from the successive die station to the first die station.

18. The transfer apparatus as claimed in claim 17 wherein the at least one drive shaft is urged in the lateral direction by a crossbar, the crossbar being connected to a pusher arm, the pusher arm being mounted on the support surface for movement substantially in the lateral direction.

19. The transfer apparatus as claimed in claim 18 wherein the pusher arm is actuated by the press ram.

20. The transfer apparatus as claimed in claim 19 wherein a linear cam is provided to urge lateral motion of the pusher arm, and wherein the linear cam is mounted to and extending below the press ram and includes a guide slot;

the guide slot including an inner slot segment and an outer slot segment including upper and lower ends, the inner slot segment intersecting with the outer slot segment at an upper intersection in the vicinity of the upper end, and the inner slot segment also intersecting with the outer slot segment in the vicinity of the lower end, the inner slot segment including a vertical inner slot portion positioned substantially vertically, the inner slot segment also including an upper inclined slot portion, extending between a top end of the vertical inner slot portion and the upper intersection, and a lower inclined slot portion extending between a bottom end of the vertical inner slot portion and the lower intersection;

the transfer apparatus additionally including a cam follower mounted on the pusher arm, the cam follower being positioned in and guided by the inner slot segment and the outer slot segment; and the linear cam including a bridge pivotally attached to the linear cam and positioned in the guide slot at the upper intersection, the bridge being pivotable between a first position and a second position, the bridge being biased to the first position, the bridge being disposed in the first position and directing the cam follower into the inner slot segment when the press ram moves from the fully closed position to the fully open position, and the bridge being disposed in the second position and permitting the cam follower to be guided from the lower end to the upper end along the outer slot segment when the press ram moves from the fully open position to the fully closed position, the configuration of the guide slot being such that, as the press ram moves from the fully closed position to the fully open position, the cam follower is directed by the guide slot in the lateral direction, causing the pusher arm to move in the lateral direction, and as the linear cam moves from the fully open position to the fully closed position, the cam follower is not directed in the lateral direction, whereby movement of the press ram from the fully closed position to the fully open position causes movement of the pusher arm in the lateral direction, and movement of the press ram from the fully open position to the fully closed position causes substantially no movement of the pusher arm in the lateral direction.

21. The transfer apparatus as claimed in claim 20 wherein the upper inclined slot is inclined from the inner slot to the outer slot at an angle of inclination above the horizontal, and wherein the lower inclined slot is inclined from the inner slot to the outer slot at an angle of inclination below the horizontal.

22. A transfer apparatus as defined in claim 17 wherein the transfer apparatus includes two gears, two drive shafts, and two linkages coupling the two drive shafts to the finger bar.

23. A transfer apparatus for transferring workpieces between die stations, the die stations being spaced from each other in a longitudinal direction, movement from a die station to a successive die station being in a second longitudinal direction, the transfer apparatus having:

a support surface, the support surface being substantially horizontal and stationary;

a press ram positioned above the support surface, the press ram being movable substantially vertically between a fully closed position and a fully open position; a striker cam mounted on and extending below the press ram;

a drive gear rotatable about a drive gear axis, the drive gear axis being substantially horizontal, the drive gear having an eccentrically mounted cam follower having a contact surface thereon for engagement with the striker cam, and the drive gear having peripheral teeth;

an elongate gear rack slidably mounted on the support surface for movement between a first gear rack position and a second gear rack position, the gear rack having gear rack teeth, the peripheral teeth being engagable with the gear rack teeth such that, when the press ram moves from the fully open position to the fully closed position, the striker cam engages the contact surface, causing the drive gear to rotate about the drive gear axis, thereby causing the peripheral teeth to engage the gear rack teeth and to urge the gear rack to move in the second longitudinal direction from the first gear rack position to the second gear rack position;

an extendible member having a first end fixedly mounted on the support surface, and a retractable second end connected to the gear rack, the extendible member biasing the gear rack to the first gear rack position, such that when the press ram is in the fully closed position, the gear rack is in the second gear rack position and the eccentrically mounted cam follower acts as a detent restraining the gear rack from moving in a first longitudinal direction to the first gear rack position, the first longitudinal direction being opposite to the second longitudinal direction, and when the press ram is in the open position, the gear rack is in the first gear rack position, movement of the press ram from the fully closed position to the fully open position resulting in the extendible member urging the gear rack from the second gear rack position to the first gear rack position;

at least one gear rotatable about a gear axis, the at least one gear axis being substantially parallel to a lateral direction, the lateral direction being substantially horizontal and orthogonal to the longitudinal direction, the at least one gear having gear teeth engaged with the gear rack teeth, such that movement of the gear rack in the first longitudinal direction and in the second longitudinal direction causes rotation of the at least one gear about the at least one gear axis, the at least one gear having a throughbore aperture;

at least one drive shaft, slidably received in the throughbore aperture, coaxial with the at least one gear and engagable with the at least one gear, such that rotation of the at least one gear about the at least one gear axis causes rotation of the at least one drive shaft, the at least one drive shaft having a second end positioned in the vicinity of the gear rack;

a finger bar;

at least one linkage for linking the second end of the at least one drive shaft to the finger bar, the at least one linkage being pivotally mounted to the finger bar at a point radially disposed from the at least one gear axis, the at least one linkage also being coupled to the second end of the at least one drive shaft, such that movement of the gear rack in the first longitudinal direction causes the finger bar to travel in an arcuate path and generally in the second longitudinal direction from the first die station to the successive die station, the workpiece remaining substantially vertical while travelling along the arcuate path, and movement of the gear rack in the second longitudinal direction causes the finger bar to travel in the arcuate path and generally in the first longitudinal direction from the successive die station to the first die station;

the at least one drive shaft being urged in the lateral direction by a crossbar, the crossbar being connected to a pusher arm, the pusher arm being mounted on the support surface for movement substantially in the lateral direction;

a linear cam for urging movement of the pusher arm in the lateral direction, the linear cam being mounted to and extending below the press ram;

the linear cam including a guide slot;

the guide slot including an inner slot segment and an outer slot segment including upper and lower ends, the inner slot segment intersecting with the outer slot segment at an upper intersection in the vicinity of the upper end, and the inner slot segment also intersecting with the outer slot segment in the vicinity of the lower end, the inner slot segment including a vertical inner slot portion positioned substantially vertically, the inner slot segment also including an upper inclined slot portion, extending between a top end of the vertical inner slot portion and the upper intersection, and a lower inclined slot portion extending between a bottom end of the vertical inner slot portion and the lower intersection;

the transfer apparatus additionally including a cam follower mounted on the pusher arm, the cam follower being positioned in and guided by the inner slot segment and the outer slot segment; and the linear cam including a bridge pivotally attached to the linear cam and positioned in the guide slot at the upper intersection, the bridge being pivotable between a first position and a second position, the bridge being biased to the first position, the bridge being disposed in the first position and directing the cam follower into the inner slot segment when the press ram moves from the fully closed position to the fully open position, and the bridge being disposed in the second position and permitting the cam follower to be guided from the lower end to the upper end along the outer slot segment when the press ram moves from the fully open position to the fully closed position, the configuration of the guide slot being such that, as the press ram moves from the fully closed position to the fully open position, the cam follower is directed by the guide slot in the lateral direction, causing the pusher arm to move in the lateral direction, and as the linear cam moves from the fully open position to the fully closed position, the cam follower is not directed in the lateral direction, whereby movement of the press ram from the fully closed position to the fully open position causes movement of the pusher arm in the lateral direction, and movement of the press ram from the fully open position to the fully closed position causes substantially no movement of the pusher arm in the lateral direction.

24. A transfer apparatus as defined in claim 23 wherein the pusher arm additionally includes a collapsible member connecting the crossbar to the pusher arm, to act as a shock absorber for absorbing shocks and vibrations directed to the crossbar and the pusher arm substantially in the first lateral direction and in the second lateral direction during operation of the transfer apparatus.

25. A transfer apparatus as defined in claim 24 wherein the collapsible member is a gas cylinder in which the gas cylinder contains a gas under pressure of about 300 psi.

26. A transfer apparatus as defined in claim 23 in which the extendible member is a gas piston-cylinder assembly, the gas piston-cylinder assembly having an anchor end secured to the support surface and a movable end secured to the gear rack.

27. A pair of opposed, spaced apart transfer apparatuses, each as defined in claim 23, the transfer apparatuses being synchronized with each other and cooperating with each other to move the workpieces from the first die station to the successive die station along the arcuate path, the workpieces remaining substantially vertical while moving along the arcuate path.

* * * * *